US006848750B2

(12) United States Patent
Hurwitz

(10) Patent No.: US 6,848,750 B2
(45) **Date of Patent: *Feb. 1, 2005**

(54) GENERATION OF IN-LINE SKATES AND SKATE-BOARDS WITH SAFETY "EDGING FRICTION CONTROL™"

(76) Inventor: Myron Stuart Hurwitz, 4420 Forest Glen Ct., Annandale, VA (US) 22003

( * ) Notice: Subject to any disclaimer, the term of this patent is extended or adjusted under 35 U.S.C. 154(b) by 0 days.

This patent is subject to a terminal disclaimer.

(21) Appl. No.: 10/462,631

(22) Filed: Jun. 17, 2003

(65) Prior Publication Data

US 2004/0026984 A1 Feb. 12, 2004

Related U.S. Application Data

(62) Division of application No. 09/782,079, filed on Feb. 14, 2001, now Pat. No. 6,637,827.

(60) Provisional application No. 60/185,496, filed on Feb. 28, 2000, and provisional application No. 60/194,013, filed on Apr. 3, 2000.

(51) Int. Cl.[7] ..... A63C 17/22

(52) U.S. Cl. ..... 301/5.301; 301/5.304; 152/40; 152/87; 188/68; 280/11.204; 280/842

(58) Field of Search ..... 301/5.301, 5.304, 301/5.305, 5.7; 280/11.221, 11.223, 11.226, 11.204, 11.207, 11.208, 11.224; 188/29, 68, 74; 384/495, 496, 497, 498; 152/17, 40, 87

(56) References Cited

U.S. PATENT DOCUMENTS

| | | | | |
|---|---|---|---|---|
| 4,706,974 A | | 11/1987 | Vincent | |
| 5,192,088 A | | 3/1993 | Yu | |
| 5,192,099 A | * | 3/1993 | Riutta | 280/11.201 |
| 5,397,138 A | | 3/1995 | Mangelsdorf | |
| 5,401,037 A | | 3/1995 | O'Donnell et al. | |
| 5,403,021 A | | 4/1995 | Shifrin | |
| 5,470,086 A | | 11/1995 | Peterson et al. | |
| 5,486,011 A | | 1/1996 | Nelson | |
| 5,527,100 A | | 6/1996 | O'Donnell et al. | |
| 5,551,711 A | | 9/1996 | Mangelsdorf | |
| 5,564,790 A | | 10/1996 | Lekavich | |
| 5,609,346 A | | 3/1997 | Bellehumeur | |
| 5,657,999 A | | 8/1997 | Beaulieu | |
| 5,667,280 A | | 9/1997 | Hansen | |
| 5,813,678 A | | 9/1998 | Robins | |
| 5,823,634 A | | 10/1998 | Pozzobon | |
| 5,873,583 A | | 2/1999 | Moore | |
| 5,938,214 A | * | 8/1999 | Roman et al. | 280/11.224 |
| 5,951,027 A | * | 9/1999 | Oyen et al. | 280/11.225 |
| 5,997,015 A | | 12/1999 | Bellehumeur | |
| 6,010,136 A | | 1/2000 | Hoskin | |
| 6,019,378 A | | 2/2000 | Cushing | |
| 6,065,760 A | | 5/2000 | Weygandt | |
| 6,217,038 B1 | * | 4/2001 | Moe | 280/11.207 |

FOREIGN PATENT DOCUMENTS

DE 19646323 * 11/1998

* cited by examiner

*Primary Examiner*—Russell D. Stormer

(57) ABSTRACT

The frame of an in-line skate (FIG. 8B) supports a wheel (10), allowing a skater to effectively slow down and stop, using an athletic stance that skiers on snow and ice skaters on ice use. The wheel (10) has a hub (20A), allowing a wheel to rotate around the axle (13A) vertically and at an inclination. The hub has axle roller bearings (23B). The wheel (10) includes friction band surfaces (11A) on the sides of the wheel. When rotating at an inclination the wheel's friction surface contacts a friction surface (11B), inside the wheel-well or an axle friction surface or a combination thereof to slow or brake the wheel. The wheel (10) assembly includes self-aligning springs (14A/B). Individual parts can be technically designed to allow various model solutions that will satisfy the abilities of a beginner to an expert. The wheel assembly frame can be attached to an in-line skate, an in-line skateboard, a downhill in-line ski and a downhill in-line skateboard.

44 Claims, 20 Drawing Sheets

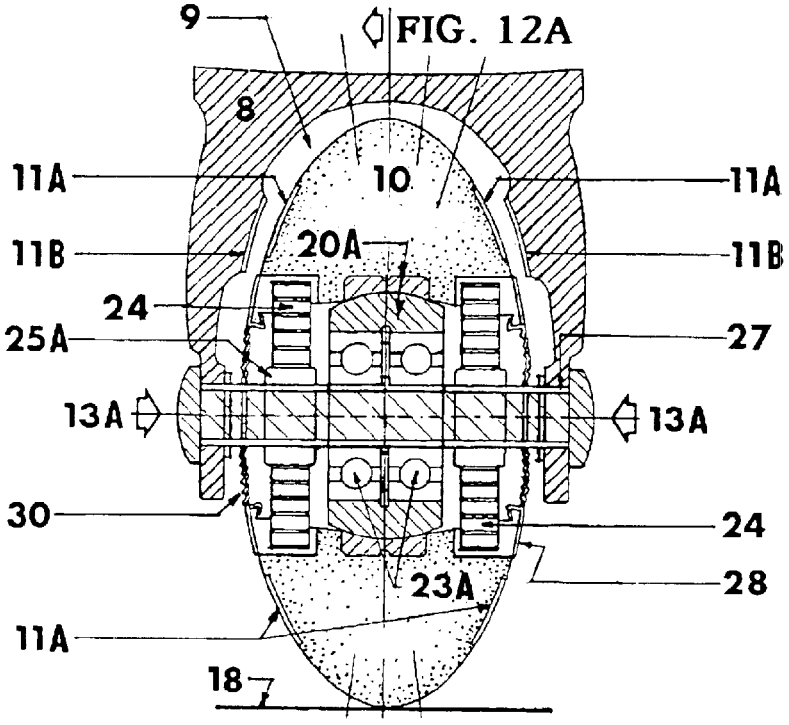
FIG. 7 A
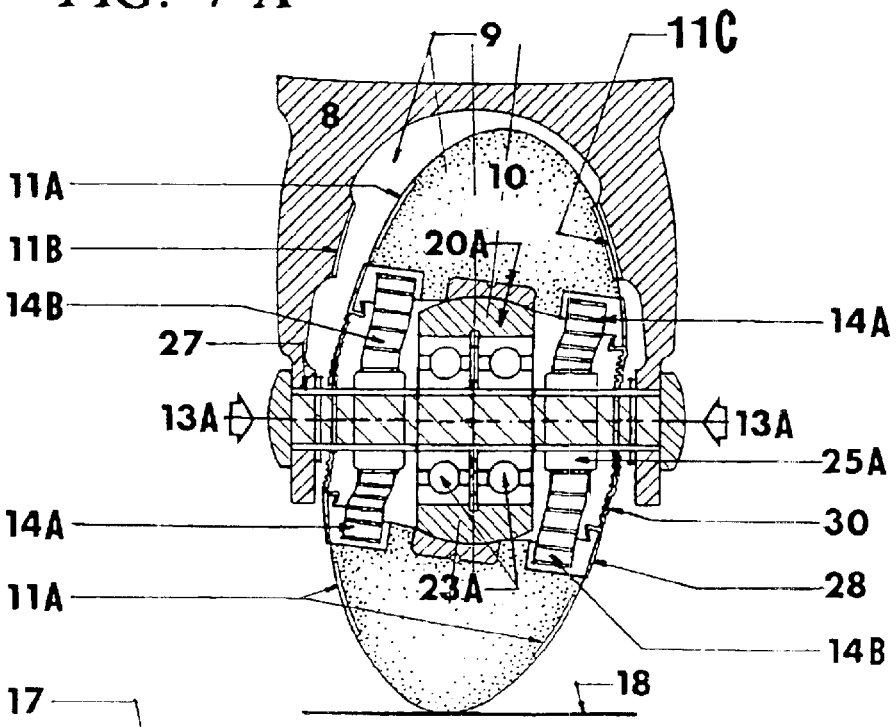
FIG. 7 B
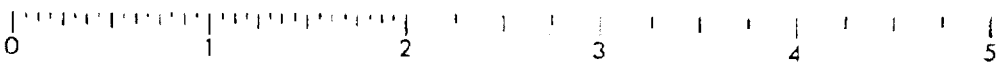

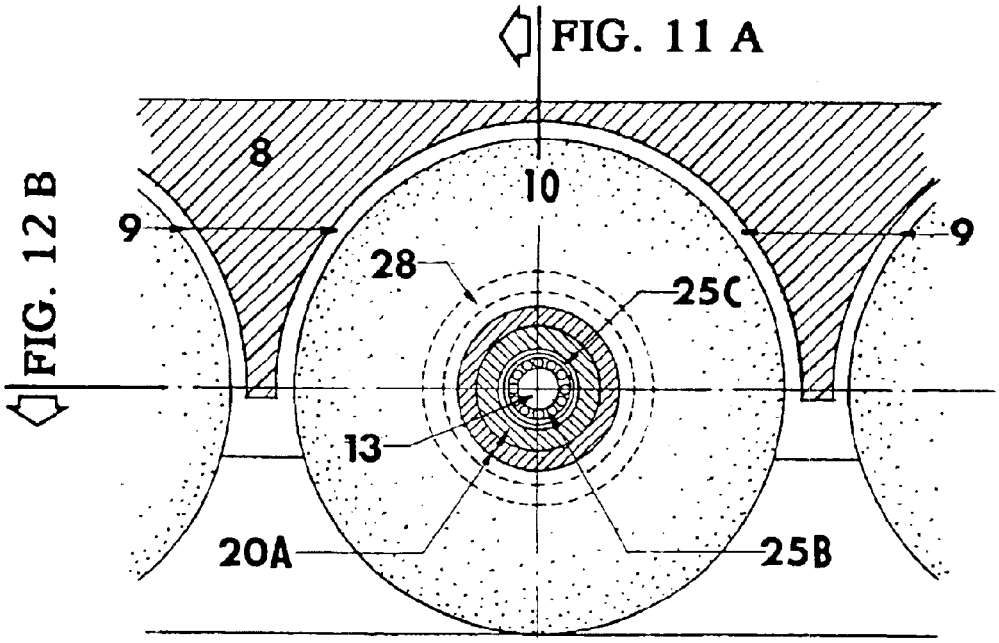
FIG. 12 A
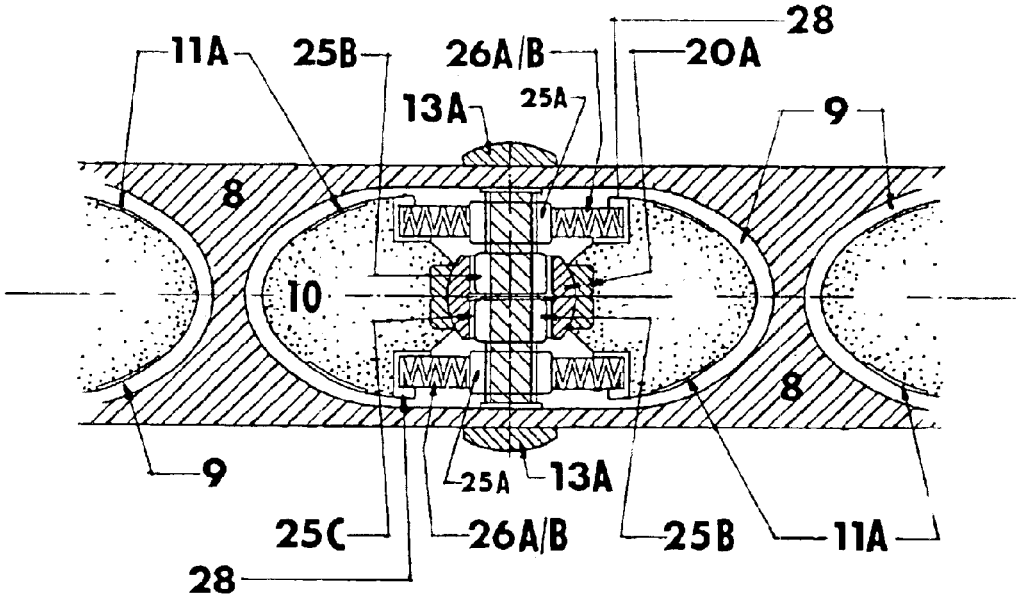
FIG. 12 B
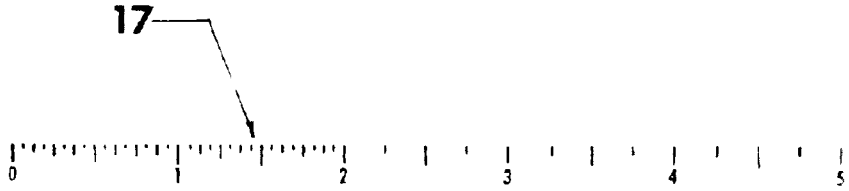

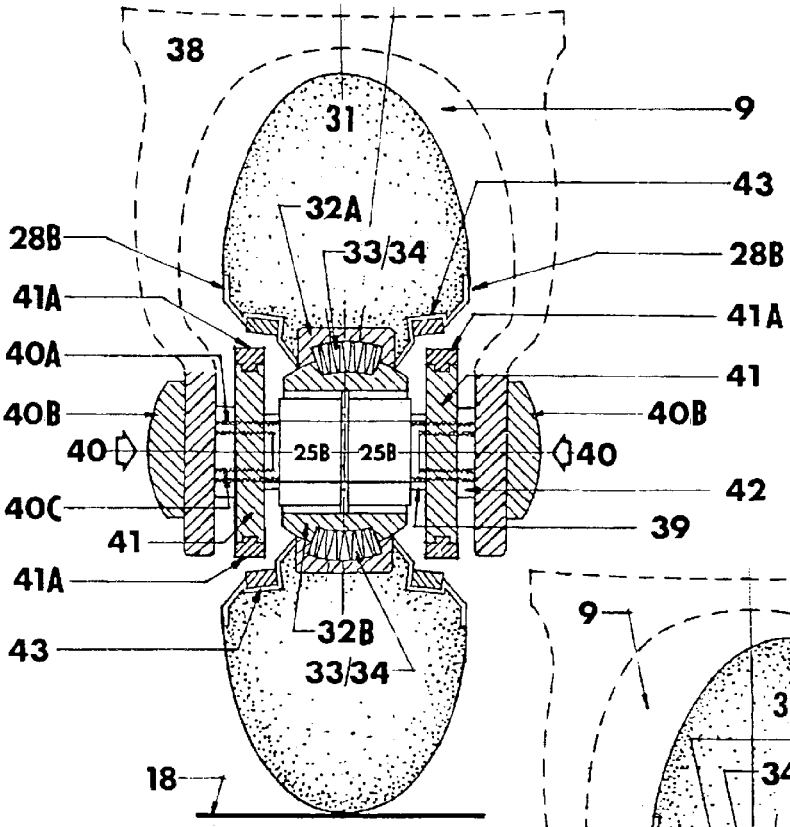
FIG. 16 A
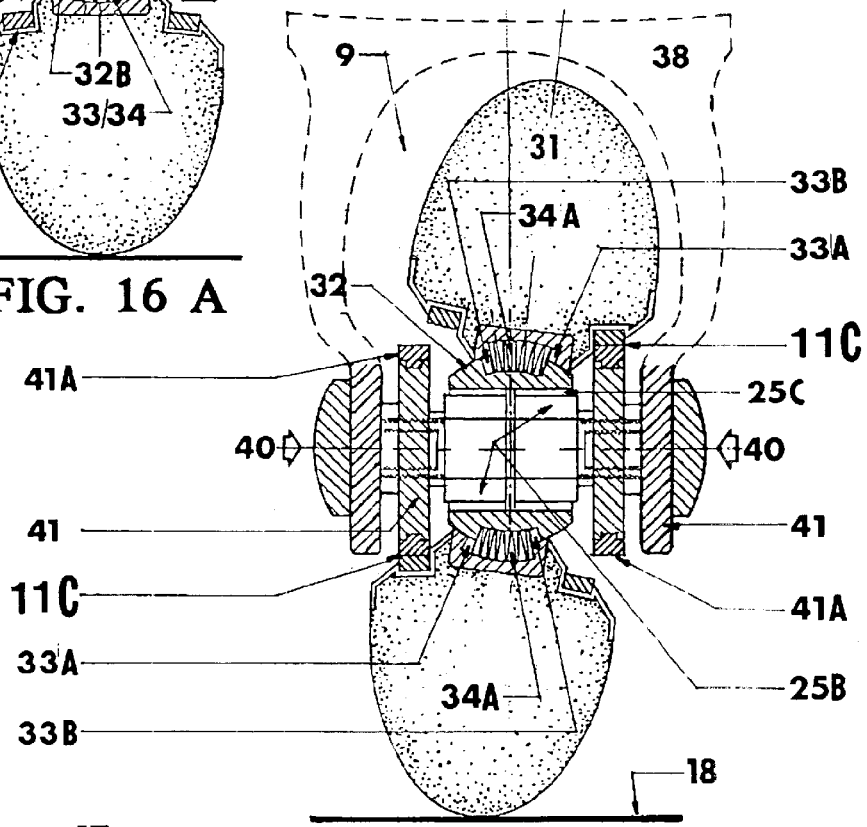
FIG. 16 B
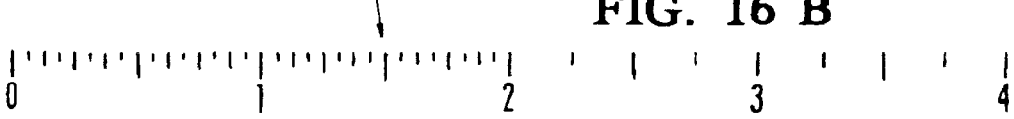

GENERATION OF IN-LINE SKATES AND SKATE-BOARDS WITH SAFETY "EDGING FRICTION CONTROL™"

This application is a divisional application of U.S. application Ser. No. 09/782,079, filed Feb. 14, 2001, and now U.S. Pat. No. 6,637,827.

This Application is entitled to the benefit of Provisional Patent Applications Ser. No. 60/185,496, filed Feb. 28, 2000 and Ser. No. 60/194,013, filed Apr. 3, 2000.

BACKGROUND OF INVENTION

1. Field of Invention

This invention relates to in-line skates, specifically to improve safety by providing the mechanical means to control speed and to abruptly stop.

2. Status of Prior Art

In-line skating in recent years has become an explosively popular sport, especially for adults. The composite boot, wheel frame and wheels have become progressively sophisticated and specifically engineered for all categories of recreational and competitive sport use. The high end retail price of such skates can be as much as $800 or more.

Watching an in-line skater is almost akin to watching an ice skater effortlessly glide across ice. However, the safety factor of edging skate blades on ice to abruptly stop; or comparably edging skis on snow to control one's downhill speed or stop is not the same nor presently possible for in-line skates on a concrete or asphalt surface.

The protective knee pads, elbow pads, wrist pads and helmet are testament to the fact that safely slowing down and quickly stopping are very difficult (if not impossible) maneuvers to do—and falling on concrete or asphalt is quite different from falling on snow or ice.

Though many enthusiasts are attracted to the sport and tempted to try it out, the available state of the art use of a rubber heel brake pad to slow down and stop is recognized as being unnatural and ineffective. To initiate this "braking" maneuver, the skater must get into an awkward backward pressure leaning stance and body position. In that contorted position, the pressure on the rubber heal "brake" pad, realistically does not effectively slow the skater's speed nor allow the skater to abruptly stop. Accordingly, manufacturer's handbook statements are typically replete with bold letter "WARNING!" captions, explaining and emphasizing the danger and lack of in-line skating control.

In recent years additional improvements have been made to the quality of skate boots, including a lever arm at the back of the boot that attaches directly to the heel pad to increase the backward pressure on the rubber break pad. Variations of this system have been extensively marketed but the braking method remains marginally effective in being able to slow down or abruptly stop.

Consequently, the safety factor concern is still a major deterrent to the sport and a major challenge to inventors. This is evident by the innumerable patents devoted to breaking methods for in-line skates. Because the basic components of conventionally marketed in-line skates are relatively simple: boots; wheel frame; wheels; axles; and, axle bearings; the existing braking inventions to date are too intricate, too costly and of questionable effectiveness to attract the manufacturing industry. As such, the rubber heel brake pad method of control remains the predominate commercially available, ineffective method in use.

SUMMARY OF INVENTION

In view of the foregoing, the main object of this invention is to provide in-line skates with a more athletically natural means to control speed and abruptly stop, without the need for a heel braking pad or other currently available ineffective means.

This "EDGING CONTROL™" invention will allow an in-line skater to assume a forward and sideward pressure leaning position, to control speed and abruptly stop. That technique is comparable to the body stance and forces applied, when pressing ice skate blades against ice or the bottom, side edges of skis against snow.

To achieve this safety "EDGING FRICTION CONTROL™" invention for in-line skates, required resolving four basic and novel concepts. After doing so, the total time consuming effort was devoted to the refinement of all the details (including a partial mock-up) and striving for product practicality and simplicity. This meant striving to keep overall dimensions as close to respective current sate of the art dimensions as possible and using stock sized parts where feasible. Doing so, it was reasoned, would make the invention more conducive and acceptable to manufacturers, as well as making it advantageously easier and less expensive to make a finished prototype model.

The four initial, fundamental concepts to the invention were:

A. The in-line skate wheels not only had to conventionally rotate vertically around a fixed axle, but also had to rotate at an inclined angle around the fixed axle, to cause friction contact ("EDGING CONTROL™") within the wheel-wells of the skate frame. That interactive contact by friction band surfaces fused to each side of the wheels, against formed friction stip surfaces bonded to and within the wheel-wells of the frame, would in essence be comparable to ice skate edges "scoring" ice and ski edges "scoring" ice and snow to effectively control speed or to abruptly stop.

B. For the wheel to conventionally rotate around an axle in a vertical axis plane as well as at an inclined angle, it was apparent that the hub of the wheel could not be the same as presently manufactured. A conventionally marketed wheel has a hub that is typically a fixed, rigid plastic unit, which is cast in with the urethane tire material. In addition, the outside faces of the rigid hub are conventionally flush with both side faces of the wheel.

By comparison, for the wheel to rotate both vertically and at an inclined angle around a fixed axle, the wheel hub would have to be functionally different. There would also have to be depressions at both center side faces of the wheel (in both an unfinished and finished state). Such open space at both center side faces of the wheel, would allow the wheel to rotate at an inclined angle around a fixed horizontal axle.

C. The next problem to solve was what kind of functional wheel hub unit would be needed to allow both vertical and inclined rotation? Initially, the concept was to have a solid stainless steel ball welded to, and at the center of the wheel axle. Around that center axle ball, would be a conforming stainless steel concave ring wheel hub that would encase the steel axle ball.

While the concept seemed feasible, after reviewing the completed details of that solution, concerns about practicality and the undiminished desire to use stock parts, resulted in the driving force to seek a better solution. After a significant effort, an existing stock bearing that came in a myriad of diameters and bore sizes was considered. That bearing is called a "plain spherical bearing". Using that bearing as an in-line skate wheel hub would allow the wheel to rotate both vertically and at an inclination around a fixed axle.

D. The final fundamental problem to resolve was one that was difficult to ignore. Once EDGING force was applied (as in a side to side "striding" motion) and then released, would the wheel(s) return to the vertical axis plane ("coasting") position? Uncertain whether forward motion centrifugal forces alone would accomplish that result, that potential problem had to be considered and resolved. A satisfactory solution would be to conceive a simple component—a tension-compression spring, that would result in self-aligning wheels.

In a catalog having a myriad of industrial use parts (McMaster-Carr Supply Company Catalog 105), in the last section on springs at the bottom of the last page (no. 3,047) that component was found. It was a spring that could be feasibly used as the self-aligning required component. Called "Stainless Steel Constant-Force Springs", they are comparable to a tape measure and come in all widths and thicknesses. While not the accordion pleated sheet metal spring originally theorized, it seemed to be a desirable alternate stock part to use.

Having resolved the forgoing fundamental initial concepts, the next problem that surfaced became apparent in the process of drawing a preliminary cross section detail of the wheel/frame assembly. Though the center or core of the fabricated "constant force spring" would essentially be ¼" I.D. (inside diameter) to fit and revolve around a standard ¼" O.D. (outside diameter) axle, it was evident that when tension and compression forces were applied to the revolving springs (at each end of the wheel axle), the core of the spring would begin to score the axle. Apparently, the whole self-aligning spring idea could only work if the center of the spring was bonded to an axle roller bearing.

The crucial problem with that realization was that the smallest roller ball bearing with a ¼" I.D. bore (to fit the standard ¼" O.D. axle) had an outside diameter of ¾, which left only ¼"± of space around the bearing for a spring. Certainly, that minimal ¼"± would hardly be enough space for a sufficient number of spring coils to be effective either in tension or compression (the same reality applying to a theoretical sheet metal accordion pleated spring, originally considered).

With that grim realization it was back to square one, trying to resolve the "self-aligning spring" problem. Hoping that there might be another type of stock axle bearing that would have a ¼" bore and still be small enough in its outside diameter to accommodate an effective coil spring, another telephone sized catalog for bearings was researched. Having scrutinized the catalog many times previously and expecting this effort to be futile, in the next to the last section of the catalog, the necessary stock size bearing component was found. It is called a "Needle Roller Bearing".

Now that the fundamental problems to the invention were (seemingly) resolved, the progressive development of the invention can be explained. In doing so, it must be emphasized that there was no intent to disregard stock, state of the art parts; nor to depart (as much as possible) from typical state of the art dimensions, such as: the inside face to face dimension of a typical skate frame at the wheel axle location; the standard ¼" diameter and length of a stock wheel axle; and the use of ⅞" O.D. standard roller ball axle bearings (with a bore size of 5/16" I.D., requiring a standard transitional, reducing sleeve to fit a standard ¼" O.D. axle). Further, to understand the invention, the significance of the novel use of a spherical bearing for the hub of an overall standard dimensioned, in-line skate wheel must be emphasized.

The prime novel purpose of using a dynamic, element spherical bearing for the hub of an in-line skate wheel (as compared to the conventional fixed, rigid plastic hub of an in-line skate wheel) is solely to allow for both vertical and inclined wheel angle rotation. However, it should also be emphasized, that the wheel rotation at either angle remains solely dependent (as it is in the state of the art) upon axle bearings.

After completing and analyzing the first preliminary cross section detail, using a stock sized spherical bearing wheel hub, whose bore size would accommodate standard ⅞" O.D. wheel axle ball bearings (having a 5/16" I.D. bore size for a ¼" axle(?), thus requiring a reducing sleeve), other solutions came to mind:

A. It was realized that smaller atypical ¾" O.D. wheel axle ball bearings (suitably having a standard ¼" I.D. bore size for a standard ¼" O.D. axle) could instead be used acceptably within the spherical bearing wheel hub. As such, a smaller stock sized spherical bearing wheel hub with a corresponding ¾" I.D. bore could be used.

B. Upon further analysis, it was also realized (viewing the industrial strength, needle roller axle bearings at the core of the self-aligning springs), that the same smaller spring axle bearings could also be used for the wheel axle bearings. As such (again), the stock size spherical bearing wheel hub would correspondingly be smaller with a stock sized 7/16" I.D. bore to accommodate stock sized 7/16" O.D., needle roller axle bearings within the wheel hub.

Obviously, the most desirable size of the spherical bearing wheel hub (large, medium or small) and the corresponding type and size of the axle bearings (whether single or double bearings, as is customarily used) would be a manufacturers choice and decision predicated on simulated computer analysis and prototype testing. In addition, while the material of the stock sized, industrially use spherical bearing is typically steel, when used instead as the dynamic (two element) hub of an in-line skate, the material of the bearing could certainly be plastic or a light weight alloy.

Aside from the spherical bearing wheel hub and axle bearings, the self-aligning, tension/compression springs located at each end of the axle, need to be explained as well. While the stock "Stainless Steel Constant-Force Springs" are a viable choice to be used as self-aligning springs for in-line skate wheels, other custom materials and design types of springs could be used. For instance, the stainless steel coil "tape measure" or strip type material could instead be plastic. In addition, the self-aligning spring, instead of being an open coil spring could instead be a closed accordion pleated sheet metal or reinforced rubberized material type of spring. Such a "closed" spring could also serve a dual purpose as a dust cover (if that latter element is deemed to be significant in the evaluation of the wheel assembly by the manufacturer).

In further analysis of the self-aligning spring, another idea surfaced—a novel dual purpose spherical bearing for the hub of an in-line skate wheel. The reasoning that led to this conception is as follows. In using a spherical bearing for the hub of an in-line skate wheel to provide the means, for inclined angle wheel rotation, it was recognized that since the outer ring of the bearing was omni-directional, the wheel assembly also depended upon the opposite reacting, self-aligning springs -(at each end of the wheel axle) for another function.

The springs, as such, actually serve two purposes. Not only do they realign the inclined (edging function) wheel(s) to a vertical position, they also help to maintain the rotating wheel(s) at a right angle to the forward motion line of travel (coasting position). Recognized as well was the fact that forward motion centrifugal force would additionally contribute to keep the wheel(s) in a straight ahead, vertical position.

However, even in consideration of the above rationle, there remained a lingering sense of uncertainty. Feeling that it would be advantageous to have a custom spherical bearing that would not be totally omni-directional but would instead be limited to one side to side inclination motion, a novel solution evolved, ironically as a result of a prior detail solution that did not work.

Visualize that the spherical bearing's inner and outer rings are aligned in the same plane. Centered and within the concave surface of the outer ring is half of a curved rectangular recess. Opposite that recess and centered within convex surface of the inner ring is an equal half of a curved rectangular recess such that both recesses form a complete, split curved rectangular, circular recess within the center of the spherical bearing's inner and outer rings.

Within that circular, curved rectangular sealed void of the spherical bearing would either be, e.g., a self-lubricated coil compression spring; a circular accordion pleated sheet metal spring; or, a circular urethane compression spring. As such, when the inner ring bore of the spherical bearing is held rigidly in a horizontal position by axle bearings and an axle, and the outer ring is in an inclined EDGING position, the split circular rectangular shaped recesses (in the inner and outer rings) become offset (sliding by each other), compressing the internal spring at the top and bottom of the spherical bearing.

The result is equal and opposite compressive forces. As such, when the external "EDGING" force is released, the outer inclined ring (of the wheel hub) returns to the vertical (coasting) position. Also, because of the inherent workings of the internal spring of the spherical bearing (hub), the movement of the inner and outer rings are no longer omni-directional but are essentially limited to one side to side inclination motion.

While the prior details (based upon using external self-adjusting springs) remain a viable solution that could be advantageous, where excessive tensile and compressive forces may be required, including other specific applications not as yet determinable, this new alternate approach also has distinct favorable features:

A. This dual purpose spherical bearing solution, in eliminating the external springs as separate entity parts, reduces the axle width of the wheel assembly (inside face to face dimension of the wheel frame).

B. That dimensional reduction also allows a slimmer skate wheel that now would be the same overall width as an industry standard skate wheel (1"±W.). However, as distinct from a standard skate wheel (aside from the novel dynamic, dual purpose, two-element spherical bearing hub), the concave depressions at each center side of the wheel (both in an incomplete and completed assembly state), enabling the wheel to revolve around the axle at an inclination, would still be novelly evident.

C. also, the compression spring, within the enclosed circular space of the dual purpose spherical bearing hub,; would be sealed and self-lubricated.

Now having completed this seemingly last alternate solution and reviewing and reflecting on the results of all the work and effort expended, one could not help but think about the following: how could anyone get around the intended patented invention by coming up with an improved variation to overcome the present invention. Surprisingly, without too much additional effort, another alternate solution was conceived.

In essence, the idea (when reviewing the typical wheel/frame detail in the inclined "EDGING CONTROL™" position) is to insert a stationary (or fixed), solid disk part (e.g. ⅛" W.×27/32" O.D.) at a location on the axle, where it would contact the inclined skate wheel's concave frame, which frame is at the center face of the skate wheel (required at each side of the wheel to allow inclined wheel rotation around the axle).

The approximate ⅛" surface width perimeter of the fixed disk part will have a bonded friction surface material about 3/32" thick keyed into the disk. Similarly, at the exact inclined contact location on the concave frame is an indented retainer configuration for a bonded friction band contact surface material, also (e.g.) ⅛" wide×3/32± thick.

As the skate wheel rotates into the inclined position, its concave frame's indented friction band surface will contact the perimeter of the axle's fixed disk's friction surface, resulting in "EDGING FRICTION CONTROL™". In this alternate novel "EDGING CONTROL™" variation, that friction control function is entirely contained within the components of the in-line skate assembly—instead of the original novel variation, where that friction control result is achieved by the interactive contact of the friction band surface on the sides of the inclined skate wheel, with the formed friction contact strip surfaces within the wheel-well of the skate frame.

This novel alternate variation of the "EDGING FRICTION CONTROL™" invention is literally strikingly different in another functional way as well, aside from being totally contained within the wheel assembly. In the original alternate solution the edging (friction) control function is achieved by the interaction of the inclined skate wheel's friction band surface on each sidewall with the frame's wheel-well's friction strip surfaces at each side.

Whereas, in this last alternate variation the "EDGING FRICTION CONTROL™" occurs at two opposite locations—at the top perimeter of the fixed friction disk's surface, contacting the top of the rotating inclined skate wheel's concave frame's indented friction band surface on one side and simultaneously on the opposite side of the same wheel at the bottom perimeter of the fixed friction disk's surface in contact with the bottom indented friction-band surface in the inclined skate wheel's concave frame.

While the above distinction of the self-contained wheel assembly solution is that the edging control function can simultaneously occur at opposite sides (top of the fixed disk on one side of the wheel and bottom of the disk on the other side of the same wheel), it is also possible to do otherwise. The edging control function can (if desired) be limited to just the top symmetrical side of the self-contained assembly by just having the bonded perimeter friction surface only on the top half of the friction disk. This modification advantageously adds to the design versatility of this self-contained alternate solution.

In developing the alternate, self-contained wheel assembly, edging control solution, every effort was made to maintain practicality by using as many stock size parts as possible. The first problem to resolve was the simplest means to attach and stabilize the solid, friction disk part to a standard ¼" D. axle. The solution was to fine thread (¼-28) the surface of the ¼" D. axle at each end and fine thread the ¼" bore of the solid ⅛" thick friction disk. As such, the friction disk would be screwed onto each end thread of the axle, which threads would terminate at the outside faces of the axle bearings.

On one center side of the assembly, between the outside face of the axle bearing and the friction disk would be a 1/16"± thick washer. On the other end side of the friction disk, would be a ¼-28 thread locknut/spacer against and between the disk and the inside face of the wheel frame. At the end of the axle (on the outside face of the wheel frame) would be (as is typical) a male axle cap screw with an atypical thread size of (e.g.) 8–32 that would screw into the female end of the axle. The smaller (atypical) thread size of the end screw would not, as such, compromise the strength of the standard ¼" axle because of the atypical surface threads on the surface of the standard axle. Nor would the strength of the end cap screw be compromised by its smaller thread size.

To keep the overall wheel assembly dimension (inside face to face of the wheel frame) as close to the typical dimension of an in-line skate wheel frame at the axle location (1-1/16"±), would necessitate the above ¼-28 locknut spacer to be as thin as possible. Typically, ¼-32 nuts are ¼" in thickness. To find a thinner stock nut necessitated researching industrial equipment distributors (finding a ¼-28 "jamb" nut that was as thin as 5/32") and finally to a lamp parts store where a ¼-28 "fineal" nut was found that had the acceptable thickness of 3/32".

Having resolved the two basic alternate solutions (the "interactive" & "self-contained" solutions), another distinct solution became apparent. This last "self-contained" alternate variation solution could be combined with the "interactive" alternate solution into an additional distinct unified variation solution, using the dual purpose spherical bearing hub.

By having these three alternate solutions a progressive degree of EDGING FRICTION CONTROL™ is advantageously attained as follows:

1. In the interactive wheel/frame wheel-well solution there is only one EDGING FRICTION CONTROL™ location—at the top of the wheel's friction band surface, contacting the wheel well's friction strip surface.
2. In the self-contained assembly solution there are two simultaneous interactive EDGING FRICTION CONTROL™ locations. One at the top of the friction disk, contacting the concave frame's indented friction band on one side and at the same time at the bottom of the friction disk contacting the frame's indented friction band on the opposite side.
3. In the combined interactive wheel/frame wheel-well and self-contained wheel assembly solutions there are a total of THREE, EDGING FRICTION CONTROL™ locations, ONE in the the wheel/frame wheel-well solution and TWO in the self-contained wheel assembly solution.

Further, in combining the "interactive" and "self-contained" solutions into a unified variation solution, another distinct variation solution becomes evident. In addition to the combined variation solution using the novel dual purpose spherical bearing hub with the integral self-aligning compression spring, another distinct unified variation solution is evident. One that uses both the novel dual purpose spherical bearing hub with the integral self-aligning compression spring in combination with the external self-aligning springs to achieve the ultimate rapid and strongest self-aligning response.

Advantages

The advantages of having four alternate solutions to the EDGING FRICTION CONTROL™ invention:

1. the interactive "Wheel/Frame Wheel-Well" solution;
2. the self-contained "Wheel Assembly" solution;
3. the combined "Interactive Wheel/Frame" and "Self-Contained" solution using the novel dual purpose spherical bearing hub with the integral self-aligning compression spring; and,
4. the combined "Interactive Wheel/Frame" and "Self-Contained" solution using both the novel dual purpose spherical bearing hub in combination with the external self-aligning springs;

are the versatile technical design results that can be achieved. A list of those typical elements that can be varied and juxtapositioned, allowing adaptability are as follows:

1. the angle of wheel inclination to satisfy distinctive model design criteria;
2. the substance, configuration and tensile/compressive strength of the external, equal and opposite self-adjusting springs at each end of the wheel axle;
3. the substance, configuration and compressive strength of the self-lubricated spring (providing equal and opposite forces) that is enclosed within the novel, dual purpose, spherical bearing hub;
4. the composition of the plastic and/or alloy interactive friction, contact band material on each side of the wheels and the strip material on each side of the wheel-wells of the frame (interactive "Wheel/Frame Wheel-Well" solution);
5. the composition of the plastic and/or alloy interactive friction contact materials bonded to the fixed disk's perimeter and the wheel's concave frame's indented band, interactive surface (self-contained "Wheel Assembly" solution);
6. the metal alloy and/or plastic material substance of the spherical bearing hub to satisfy distinctive model design criteria;
7. the capability to combine the two distinct "interactive" and "self-contained" variation solutions into another distinct variation solution having maximum, effective EDGING FRICTION CONTROL™ in three locations, using the novel dual purpose spherical bearing hub;
8. the capability to combine the two distinct "interactive" and "self-contained" variation solutions into another distinct variation solution having maximum, effective EDGING FRICTION CONTROL™ in three locations, using the novel dual purpose spherical bearing hub in combination with the external self-aligning springs to achieve the ultimate rapid & strongest self-aligning response;
9. the capability to have all or a selective number of In-Line skate wheels (standard 4–5 or more wheels) to have the EDGING FRICTION CONTROL™ feature, which enhances design criteria by providing a more selective degree of heel to toe control for specialized use;
10. the capability to have all or a selective number of in-line skate wheels (standard 4–5 or more wheels) to have uniform EDGING FRICTION CONTROL™ from heel to toe or have variable specified degrees of that edging control by: the gradation of the abrasive contact surfaces; and/or, the gradation of the tension and compressive strength of the self-aligning springs.

Having that technical design capability will allow an extensive variety of model offerings that would not only be geared to athletic ability but to other specific conditions such as variable terrain or downhill use as well.

11. the capability to attach in-line EDGING FRICTION CONTROL™ skate frames and wheels to the bottom of standard length skis (using any one of the three edging solutions) and having conventional release bindings and ski boots. This would allow controlled summertime downhill in-line skiing on grass.

The foregoing technical design variation capabilities of the invention would allow in-line skates and skate-boards to have stock models that would typically apply to the weight, height and ability of the user (novice, intermediate, expert or professionals in track or downhill racers and hockey players ). As a result, in-line skates would have greater comparability to other popular, essentially demanding adult sports such as golf, tennis and skiing. This is especially true in a similar comparison to skiing, where the driving force in the improved refinement and cost of equipment was and is performance and safety.

Concluding Comments and Ramifications

Whereas the significant advantage of this "EDGING FRICTION CONTROL™" invention for in-line skates (and skate-boards) will allow an in-line skater to effectively, safely control their speed and to effectively stop (as is comparably done in ice skating, skiing and snow-boarding), this invention could result in additional future applications. The realization of "EDGING CONTROL™" would make it possible and could be the inception for new temperate weather recreational and competitive sports of downhill in-line skiing and snow boarding (as stated above in item number eleven).

While initially investigating in-line skates at a skiing/skating sports store, the inventor came across an in-line skate magazine named, "INLINE the skate magazine", published by In-Line, Inc., 2025 Pearl Street, Boulder, Colo. 80302. As a prelude, it should be appreciated that typically in recent years, devotees in many active sports get their greatest satisfaction by going to extremes. In-line skating and skate-boarding sports are no exceptions.

There was a fascinating article in the INLINE magazine (April/May, 1998 Edition, pgs. 37–38) about downhill in-line skaters, who are seeking to accomplish record downhill speeds, some in excess of 100 MPH! Obviously, those who indulge in such endeavors do not bother to have rubber heel brake pads on their skates. The description of these extreme skaters is phrased in awe of their suicidal speed attempts, since the only way they can stop at the bottom of the hill or mountain is to plow into bales of hay or the like.

While such downhill feats on in-line skates border on lunacy, downhill ski racing is by comparison a recognized sport attraction and is a prime Olympic competitive event, where skiers attain speeds of 80+ MPH. However, as they cross the finish line they gracefully go into a wide curved turn, "edging" their skis to slow down and in doing so, come to a safe abrupt stop. Likewise, with this "EDGING FRICTION CONTROL™" invention, in-line skaters and skate-boarders could do the same. In essence, they could safely maneuver through turns and safely control or check their speed by zigzagging or "wedeln" down the fall line, using the natural, forward leaning positions that skiers and snow-boarders gracefully assume.

There is obviously no limitation to the length and number of wheels (within self-contained framed wheel wells or self-contained assemblies with yoke supports) that would constitute a downhill in-line skate/ski or skate/snow-board, including release bindings. Ski areas that suffer through a disastrous warm or snowless winter season would be delighted to remain open during the late spring, summer and early fall seasons—in other words to be a year long, continuous operating facility. A proportionate number of downhill trails could be as groomed as a golf course fairway for seasonal, in-line and skate-boarders use.

Further, aside from in-line downhill racing becoming a more sane, competitive sport event comparable to snow skiing, downhill slalom racing could also become a competitive sport for in-line skiers—which could only be achieved by having the capability of edging friction control to maneuver around the slalom gates.

Having realized the foregoing potential possibilities for the last couple of years it was at first alarming and then totally satisfying for the inventor to a see a front cover magazine picture of an individual in a tee shirt, skiing down a grass slope! The individual was in a typical controlled edging body stance with ski poles, skis boots and skis equipped with some type of device on the bottom of the ski-boards.

Turning to pages 31–32 of the Washington Post, Friday, "Weekend" magazine section, dated Aug. 11, 2000, the bottom of the skis were not his invention, but rather a " . . . metal frame and covered by a nylon belt that moves across rollers, these surprisingly fast skis look like the treads of a snow tractor." It would seem that such "tractor treads" would substantially tear up the grass surface and be more difficult to turn and control as compared to the more simplified internal friction concept of the present invention.

The "Weekend" magazine article in the Washington post substantiates to a great extent, the future realistic potential (as outlined above) of the invention as an all encompassing season sport. As such, in-line skating on level ground would be comparable to "Cross Country Skiing" and could be called "Touring In-Line Skating" as distinct from "Downhill In-Line Skiing"—made possible by the "EDGING FRICTION CONTROL™" invention for in-line skates and skate-boards.

Having described the invention, including comparisons made to existing state of the art; the following illustrations, scaled details and respective reference numbers will assist in additional explanation and clarification of the embodiments, features and advantages of the invention.

BRIEF DESCRIPTION OF THE DRAWINGS

FIG. 7A is the first resolved cross section view (drawn to a graphic scale in inches) in accordance with the invention of a wheel frame and wheel (in a coasting position), using a stock sized dynamic 2 element spherical bearing wheel hub, having a bore size that will accommodate state of the art ⅞" O.D., roller ball axle bearings and using open coil self-aligning springs;

FIG. 7B is the same cross section view of FIG. 7A, except that the wheel is displayed in the EDGING FRICTION CONTROL™ position;

FIG. 12A is a longitudinal section view of FIG. 11A;

FIG. 12B is a plan section view of FIG. 12A;

DEFINITIONS OF ALL REFERENCE NUMERALS INDICATED IN DRAWINGS

Figure 1A:
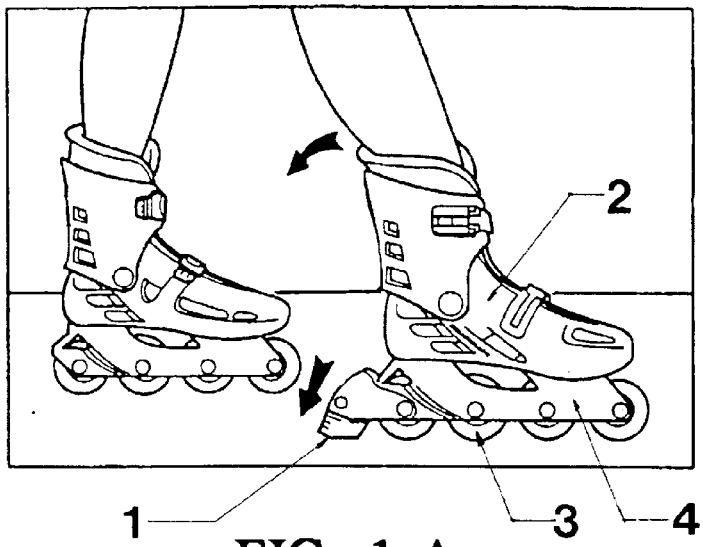
FIG. 1A illustrates a state of the art rubber heel pad brake for in-line skates.

1. Heel Brake Pad
2 Skate Boot.
3 Skate Wheel.
4 Skate Wheel Frame.
5 Awkward Leg and Back-Leaning Position to initiate ineffective "Braking" Control on In-Line Skates.
6 Natural Forward-Sideward Leaning Position to initiate effective EDGING CONTROL™ on Skis (and Ice Skates).
7 EDGING FRICTION CONTROL™
8 Skate Wheel Frame with conforming Wheel Wells.
9 Conforming Wheel-Well of Wheel Frame.
10 A generally Parabolic Shaped Wheel.
11A Friction Contact Band Surface on each side of Wheel.
11B Friction Contact Strip Surface within each side of Wheel Frame's Wheel-Well.
11C EDGING FRICTION CONTROL™ contact location.
12 Concave Wheel Depression (at both center side faces of the Parabolic Shaped Wheel) allow for Inclined Wheel Rotation.
13 Wheel Axle.
13A Axle Screw & Axle.
13B Axle Screw.
14 Self-Aligning Spring (at each side of axle).
14A Self-Aligning Spring in Compression.
14B Self-Aligning Spring in Tension.
14C Bore of Self-Aligning Spring.
15 Stainless Steel Sphere (Hub Bearing) Welded to Axle.
16 Outer Ball Bearing Casing of Sphere Wheel Hub.
17 Graphic Scale in Inches.
18 Grade.
19A Coasting Position.
19B Striding (side to side) Position.
20 Standard Spherical Bearing
20A Standard Spherical Bearing, displaying 2 Element Dynamic In-Line Skate Wheel Hub.
20B Outer Ring of Dynamic Spherical Bearing Hub.
20C Bore of standard Dynamic Spherical Bearing Hub.
20D Inner Ring of standard Dynamic Spherical Bearing Hub.
20E Example of Industrial Use Spherical Bearing Rod End.
21 Commercial State of Art In-Line Skate Wheel.
22 State of Art of single element Fixed, Rigid Plastic Hub.
23 Roller Ball Bearing.
23A Roller Ball Axle Bearing for Hub (e.g. ⅞" O.D.).
23B Roller Ball Axle Bearing for Hub (e.g. ¾" O.D.).
24 Constant Force (open coil) Self-aligning Spring.
25 Needle Roller Bearing.
25A Needle Roller Axle Bearing for Self-Aligning Spring.
25B Needle Roller Axle Bearing for Hub (e.g. 7⁄16" O.D.).
25C Ring Spacer (if needed) for Needle Roller Axle Hub Bearing to adjust to Bore diameter of Hub's Spherical Bearing.
26A Constant Force, Accordion Pleated Sheet Alloy, Self-Aligning Spring/Dust Cover.
26B Constant Force Accordion Pleated "Rubberized" Reinforced Self-Aligning Spring/Dust Cover.
27 Axle Sleeve Spacer (if needed) to adjust to standard ¼" O.D. Axle.
28 Concave Frame and Indented Retainer for Spring and Dust Cover.
28A Concave Frame and Indented Retainer for dual purpose Spring/Dust Cover.
28B Concave Frame.
29 Industry Standard (reducing) Sleeve Spacers.
29A Plastic or metal sleeve spacer as required.
30 Accordion Pleated Dust Cover with self-lubricated Collar.
31 A wheel without friction bands on the tire.
32 Novel Dual Purpose Spherical Bearing, 2 Element Dynamic In-Line Skate Wheel Hub with Integral Self-Aligning Compression Spring.
32A Outer Ring of Novel Dual Purpose Spherical Bearing.
32B Inner Ring of Novel Dual Purpose Spherical Bearing.
33 Split Circular Channel Recesses centered within the interior Concave and Convex Surfaces of the Novel Spherical Bearing.
33A Misaligned recess within the Outer Ring of the Novel Spherical Bearing in the EDGING CONTROL™ position.

33B Misaligned recess within the Inner Ring of the Novel Spherical Bearing in the EDGING CONTROL™ position.

34 Self-Lubricated Compression Spring in designed minimal dynamic force state, within the aligned split circular channel recesses of the Novel Spherical Bearing.

34A Self-Lubricated Compression Spring in designed magnum dynamic EDGING CONTROL™ state, within the offset split circular channel recesses of the Novel Dual Purpose Spherical Bearing.

35 Bore of Novel Dual Purpose Spherical Bearing.

36 Self-Lubricated, Accordion Pleated Sheet Alloy or Urethane Compression Spring in designed minimal dynamic force state.

36A Self-Lubricated, Coil Compression Spring in designed minimal dynamic force state.

37 Metal Alloy or Rigid Plastic Washer.

38 Outline of Modified Skate Frame (8). Aside from being attached to the Skate Boot, it's primary function is to support the totally Self Contained Novel "EDGING FRICTION CONTROL™" Wheel Assembly. As such, the frame is not germane to this alternate variation solution of the invention.

39 Axle Washer Spacer (e.g. ¼" I.D.×1/16" W.) between the Needle Roller Axle Bearing for the Hub (25B) and the Fixed Friction Disk (40).

39A Alloy Sleeve with inside threads (e.g. ¼-28) to match threads on surface of ¼" O.D. Axle, providing a minimal friction exterior surface for the needle roller axle bearing core of the Self-Aligning Spring.

40 Modified Standard ¼" O.D. Axle that is fine threaded (e.g. ¼-28) on the surface (40A) from each end to the outside faces of the Hub Axle Bearings (25B) and have inside fine threads (e.g. 8–32) at each end (40B) to receive Cap Screws (40C).

40A Fine Threads (e.g. ¼-28) on the Surface of a Standard ¼" O.D. Skate Axle.

40B Modified Standard Male Cap Screws (e.g. 8–32) at each end of Axle (40).

40C Inside Threads (e.g. 8–32) in each end of Axle (40) to receive Cap Screws (40B).

41 Fixed, Solid Disk (e.g. ⅛" W.×27/32" O.D.) with a center core that has ¼-28 threads, which is screwed onto the axle (40) against Washer Spacer (39) and Hub Axle Bearing (25B).

41 A Friction Surface Material bonded and keyed into the Friction Disk's perimeter (e.g. ⅛" Wide×3/32" Thick).

42 Locknut Spacer (e.g. ¼-28 threaded "Fineal" Nut) between the Fixed Friction Disk (41) and the Skate Frame (38).

43 Continuous Indentation in Concave Frame (28B) for bonded Friction Band Surface.

44 Downhill in-line Ski.

45 Downhill In-line Ski Boot.

46 In-line Ski Boot Release Binding.

47 Wheeled Device in accordance with the invention.

48 In-line Downhill Skateboard

49 In-line Skateboard

50 Rigid Material representing in-line Downhill Ski, Downhill Skateboard and in-line Skateboard.

50 Graphic Scale in Feet.

DETAILED DESCRIPTION OF THE INVENTION

To understand the variation solutions of the present invention, a clear awareness of the present state of the art of in-line skates would seem to be worthwhile. Significant to that perception would be the part of the skate (left or right) that is provided to control speed, be able to stop and the method of initiating that desired procedure.

Figure 1B:
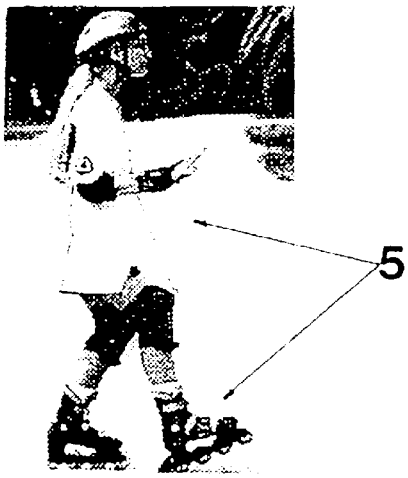
FIG. 1B illustrates an individual on in-line skates in the awkward leg and back leaning body position, applying pressure to the rubber heel brake pad in an ineffectual attempt to slow down and stop.

Accordingly, FIG. 1A is an illustration of typical in-line skates comprised of boot 2, wheel frame 4, wheels 3 and rubber heel braking pad 1 (illustrated on the right boot). In FIG. 1B an individual 5 is shown in a typical awkward braking position. The reason it is so awkward and unnatural (as well) to do is that, as you are accelerating forward, one has to extend their right leg (as illustrated), raising their boot toe and lean backward as you are going forward, trying to put pressure on the heel brake, which effort (depending on your speed) is fundamentally ineffectual.

Figure 1C:
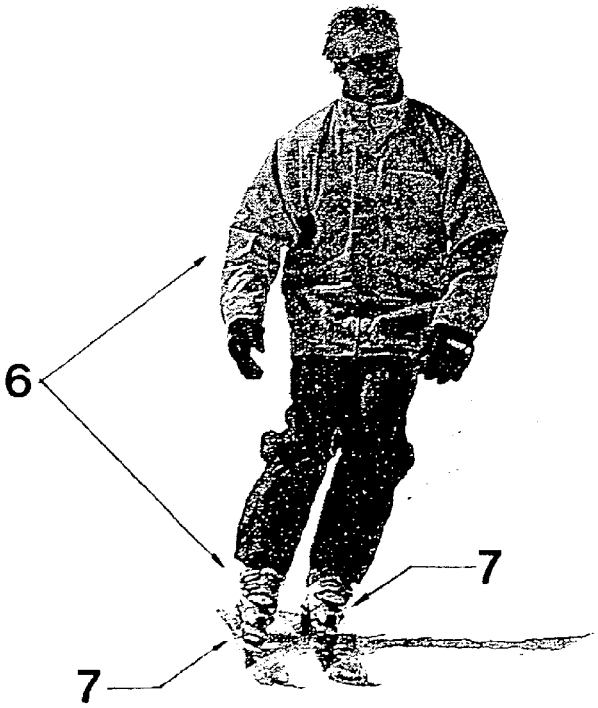
FIG. 1C illustrates an individual on skis in a more natural forward and sideward pressure leaning body position, edging skis to control speed and be able to abruptly stop.

By comparison in skiing (and similarly in ice skating) as shown in FIG. 1C, as you are accelerating forward and want to slow down and stop, you assume a more natural athletic stance by leaning forward and sideward 6, pressure edging your skis 7 (or ice skates) and effectively slowing down or safely coming to an abrupt stop.

Obviously, any method of slowing down and stopping, whether on skis, ice skates or on in-line skates depends upon friction. The rubber heel brake pad and contorted position that are required for control when using in-line skates, simply does not does not achieve that result. That fact is obvious, considering the serious injuries that all too commonly occur. Trying for a number of years to think of a better way to achieve that friction control function in a relatively simplistic way, the idea finally materialized.

Figure 2A:
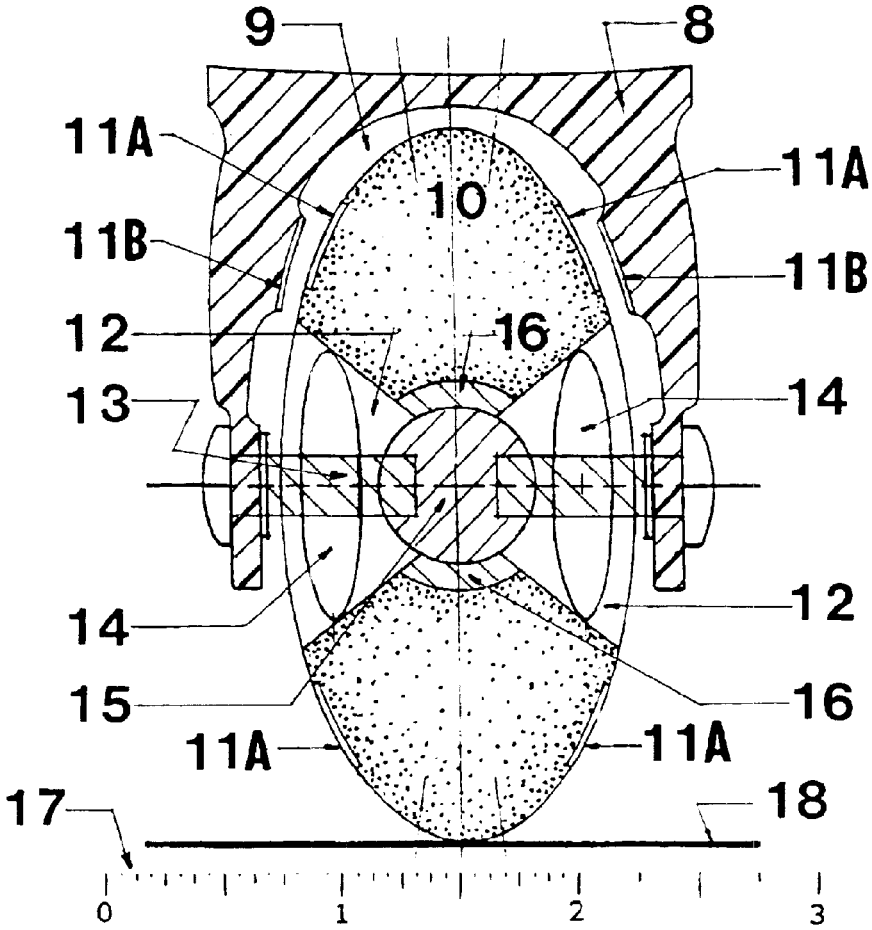
FIG. 2A is a preliminary cross section view illustrating the initial fundamental concept of the invention (drawn to a graphic scale in inches as shown) of a wheel frame and wheel of an in-line skate, wherein the skate boot is not indicated, since it has no relevance to the invention.

The inventive solution was to have a skate wheel that would have the means to rotate both vertically and at an inclination around a rigid, fixed axle. In doing so, the wheel would be able to make interactive contact with the inside surface of the skate frame's wheel-well. With that basic concept in mind and many different attempts at a solution, a preliminary cross section detail (drawn to a graphic scale 17 in inches) was completed as shown in FIG. 2A, illustrating the fundamental concepts of the invention. As conceived, in order for the wheel 10 to revolve around the axle 13 at an inclination you would need concave space 12 at both center sides of the wheel 10 for axle clearance to do so.

However, in providing those required depressions 12 and still have the required width for intended hub axle 13 bearings, it was reasoned that the wheel 10 would need to be in a parabolic shape to have that necessary center wheel hub 13 width. Further, you would need a dynamic type of hub bearing 15 that would allow both vertical and inclined rotation around the stationary axle. The elementary hub solution was a solid stainless steel ball 15 welded to a standard ¼" O.D. axle 13 and for the steel ball to be endosed in a stainless steel outer casing 16 that would be an integral part of the wheel 10.

As to the friction surface interaction between the inclined wheel 10 and the inside of the frame's 8 wheel-well 9 to achieve the desired edging effect, you would need a friction band 11A on each side of the tire 10 and friction strips 11B within the wheel-well 9. It was also recognized that when the wheel 10 was in an inclined edging mode, you would need same means in addition to centrifugal force to return the wheel back into a vertical coasting position. To do so, it was reasoned that some type of self-aligning springs 14, at each end of the axle 13, would result in equal and opposite tension and compression forces effectively resolving that self-aligning function.

Figure 2B:
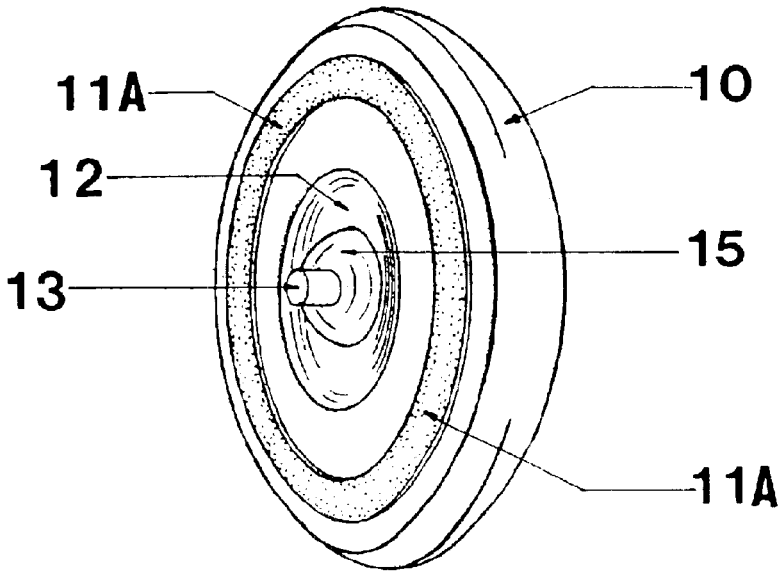
FIG. 2B is a perspective view of an initial concept parabolic shaped skate wheel in accordance with the invention, which embodiments provide the means for the wheel to rotate both vertically and at an inclination around its axle.

FIG. 2B is a perspective view of a parabolic wheel 10 displaying friction band 11A, concave depression 12, stainless steel ball hub bearing 15 and axle 13 welded to the hub bearing 15.

Figure 3A:
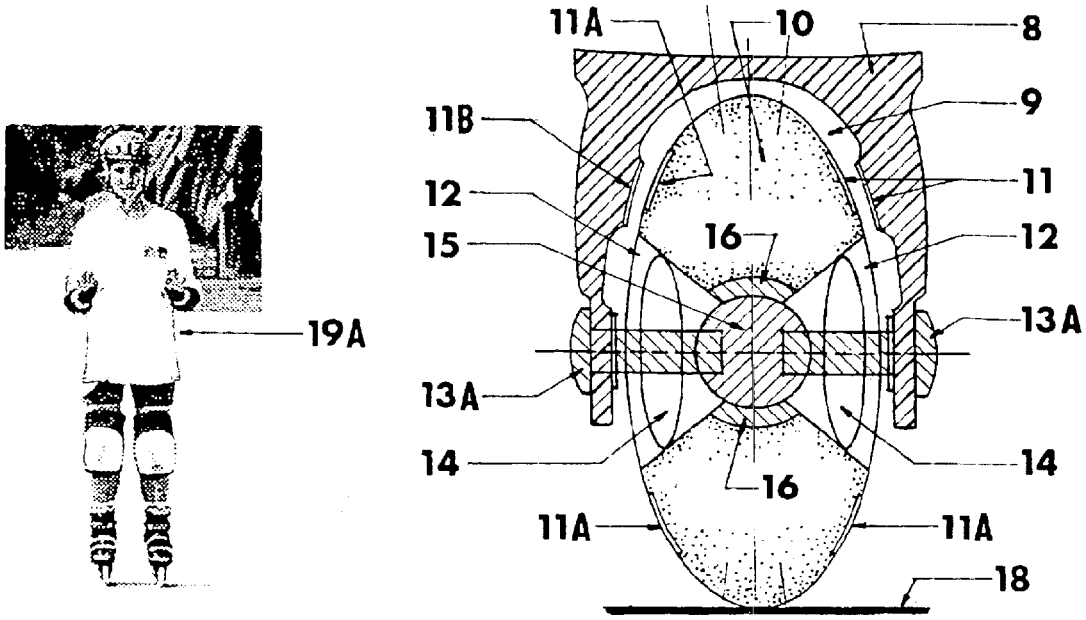
FIG. 3A is a composite illustration of an individual on in-line skates in a coasting position and a reduced repeated cross section view of FIG. 2 which wheel is also in a coasting position.

FIG. 3A-1 is an illustration of an individual on in-line skates 19A in a coasting position. Compenstively, FIG. 3A-2 (a reduced cross section view of FIG. 2A), depicts wheel 10 in the same vertical, coasting position. All the other identifiable component parts as shown in reduced cross section view FIG. 3A-2 remain the same as presented and described in the preceding full size cross section view of FIG. 2A.

Figure 3B:
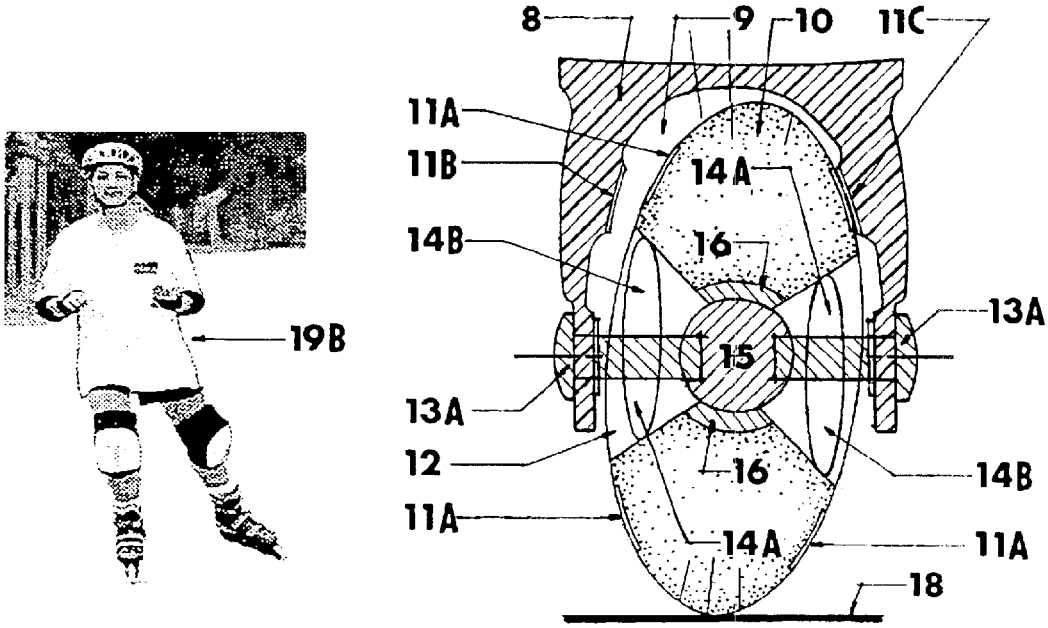
FIG. 3B is a composite illustration of an individual on in-line skates in a striding (side to side) position and a reduced modified cross section view of FIG. 2 A, depicting the wheel in a comparably inclined striding and edging position.

FIG. 3B is an illustration of an individual on in-line skates 19B in a striding (side to side) position. Correspondingly, FIG. 3B-2 the angle of FIG. 3A-2, depicts the angle of wheel 10 in an inclined striding and edging position making friction contact at 11C. In that inclined EDGING FRICTION CONTROL™ contact position at 11C, the self-aligning springs 14 are in an equal and opposite compression 14A and tension 14B state, which (as soon as the edging control force is released) will resultantly return to a state of equilibrium, wherein the wheel is back into a vertical, coasting position.

Figure 4A:
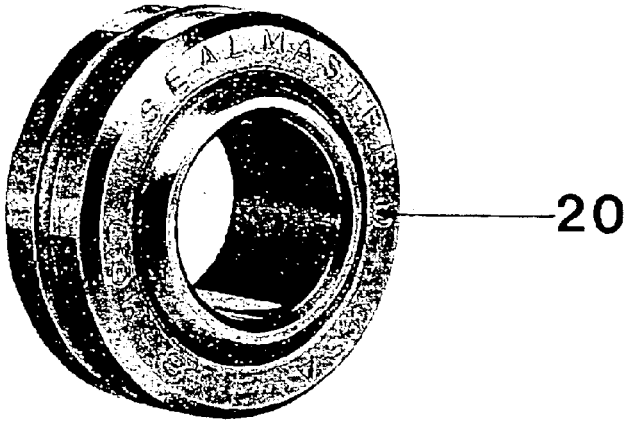
FIG. 4A is a perspective view of a spherical bearing.

FIG. 4A is a perspective view of a plain spherical bearing 20.

Figure 4B:
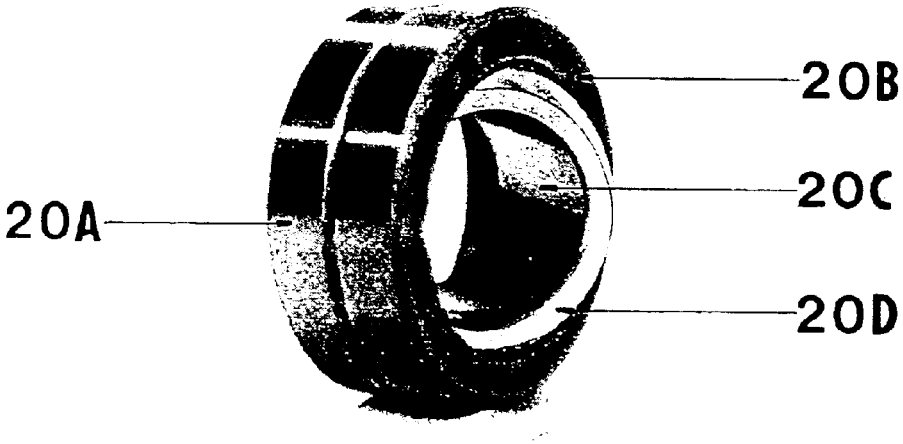
FIG. 4B is a perspective view illustrating the dynamic functionality of a spherical bearing's two element (inner and outer) rings.

FIG. 4B is a perspective view illustrating the dynamic functionality of a spherical bearing's 20A interrelated parts: the outer ring 20B; the bore 20C; and, the inner ring 20D.

Figure 4C:
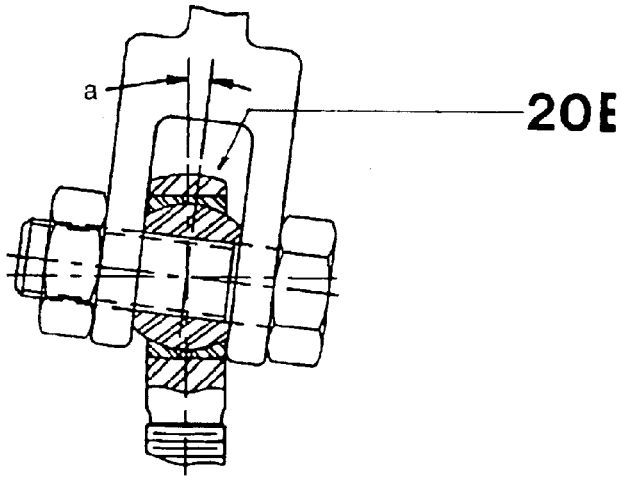
FIG. 4C is an example of an industrially used "rod end" spherical bearing.

FIG. 4C is an example illustration (just one of many types of applications) of an industrially used "rod end" spherical bearing 20E.

Figure 5A:
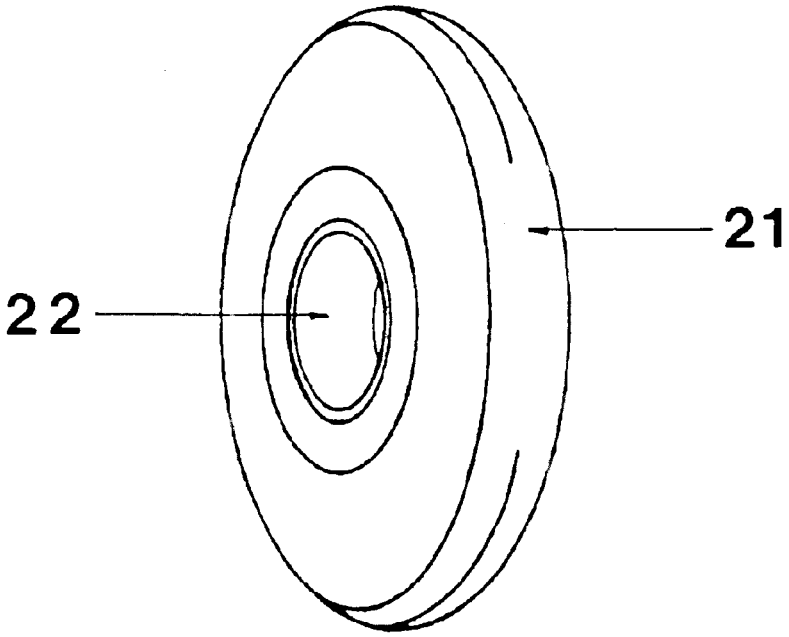
FIG. 5A is a perspective view of a state of the art in-line skate wheel with a standard, integral fixed hub.

FIG. 5A is a perspective view of a state of the art in-line skate wheel 21, having a uniformly flat service (both sides) with a standard, single element, fixed, rigid plastic hub 22, integrally cast with the wheel 21.

Figure 5B:
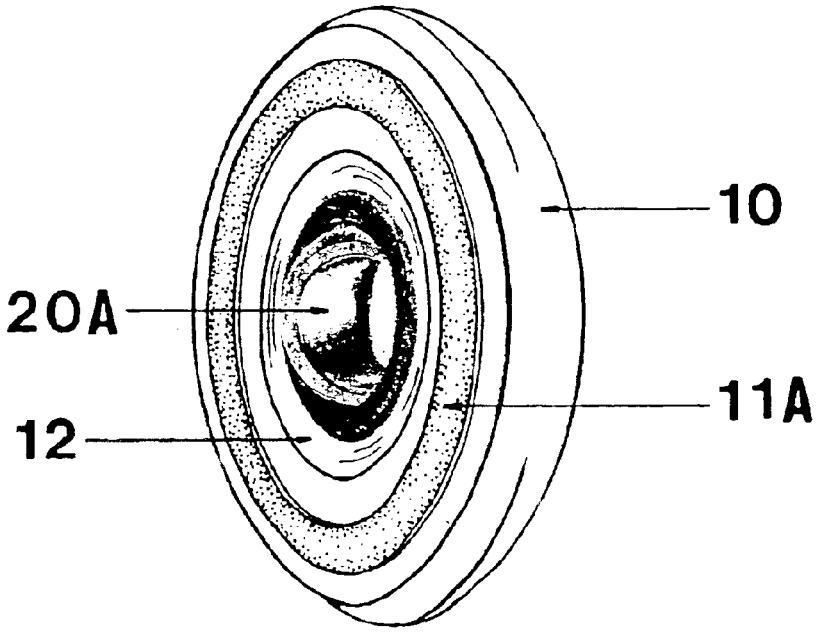
FIG. 5B is a perspective view of a parabolic wheel in accordance with the invention having a centered concave depression (both sides of the wheel) and a spherical bearing hub.

FIG. 5B is a perspective view of a parabolic in-line slate wheel 10 in accordance with the invention, having a friction contact band surface 11A, centered concave depression 12 (symmetrically on both sides), and a spherical bearing 2-element dynamic hub 20A.

Figure 6A:
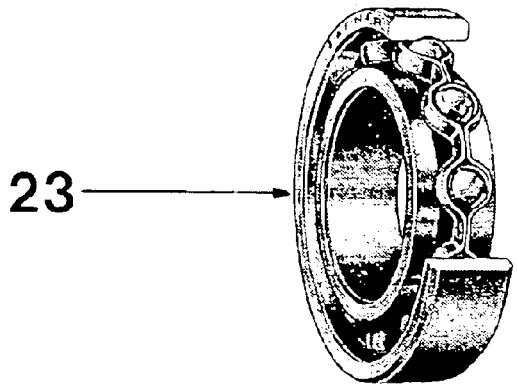
FIG. 6A is a perspective view of a roller ball bearing.

FIG. 6A is a perspective exampled view of the roller ball bearing.

Figure 6B:
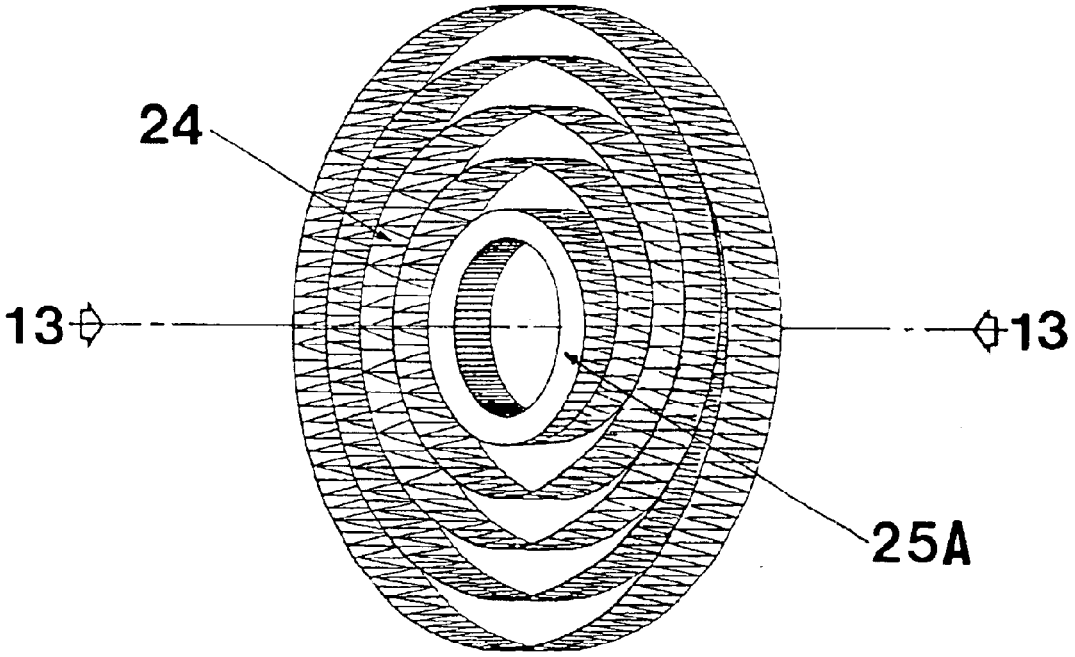
FIG. 6B is a perspective view of a constant force (open coil) self-aligning spring with a needle roller bearing hub in accordance with the invention.

FIG. 6B is a perspective exampled view of a constant force (open coil) self-aligning spring 24 with a needle roller axle bearing 25A on the wheel axle 13 in accordance with the invention.

Figure 6C:
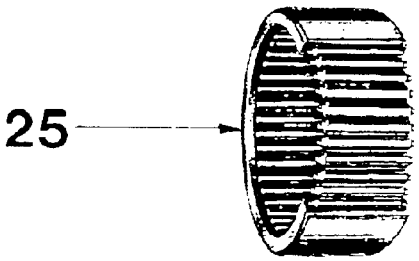
FIG. 6C is a perspective view of a needle roller bearing.

FIG. 6C is a perspective exampled view of a needle roller bearing 25.

FIG. 7A is the first resolved cross section view in accordance with the invention (drawn to a graphic scale 17 in inches) of a wheel frame 8, wheel-well 9 with friction strips 11B and parabolic shaped wheel 10 (in a vertical coasting position) with friction bands 11A. As shown, the wheel hub is a dynamic 2-element spherical bearing 20A of a stock size, such that its bore will accomodate two standard state of the art ⅞" O.D. roller ball axle bearings 23A. The width of the spherical bearing wheel hub 20A is significantly less than the overall center axle width of the wheel 10. The resulting concave depression frames 28 provide retention for the constant force, open coil self-aligning springs 24 (which have needle roller axle bearing 25A cores) and dust covers 30. Indicated as well is the axle sleeve spacer 27 as required to accommodate varying core diameters of the different assembled parts to the standard ¼" O.D. axle 13A.

FIG. 7B is the same cross section view of FIG. 7A, except that the parabolic wheel 10 is in the inclined EDGING FRICTION CONTROL™ position 11C. As shown, the only purpose for the dynamic 2-element spherical bearing hub 20A is to allow wheel 10 to rotate at an inclination. Wheel rotation is provided solely by the roller ball axle bearings 23A. Also, when the wheel 10 is at an inclination, the compression in the self-aligning springs 14A are equal and opposite to each other on each side of the axle 13A, as it is in tension 14B, forcing the rotating wheel (in conjunction with centrifugal force) back into the vertical position when edging force is released.

Figure 8A:
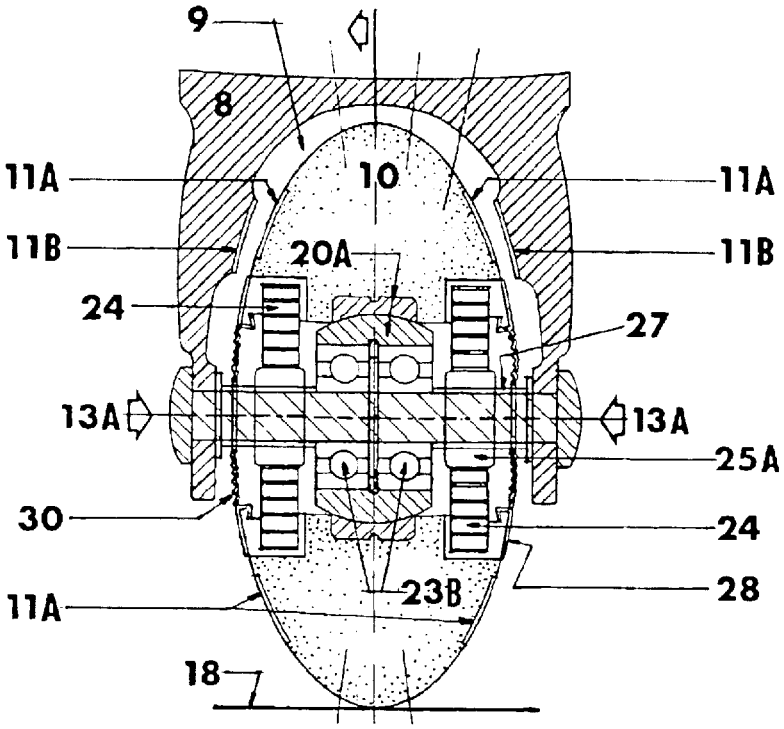
FIG. 8A is the second resolved cross section view (drawn to scale) in accordance with the invention of a wheel frame and wheel (in a coasting position) using a smaller stock sized dynamic 2-element spherical bearing wheel hub, having a smaller bore size that will accommodate atypically smaller sized ¾" O.D. roller ball axle bearings and using open coil self-aligning springs.

FIG. 8A is the second resolved cross section view in accordance with the invention (drawn to graphic scale 17 in inches) of wheel frame 8 and wheel 10 (in a vertical coasting position), using a smaller stock sized dynamic 2-element spherical bearing hub 20A, having a smaller size that will accommodate atypically smaller stock size ¾" O.D. roller ball axle bearings 23B. All other component parts displayed, remain the same kind, use and size as shown in FIG. 7A.

Figure 8B:
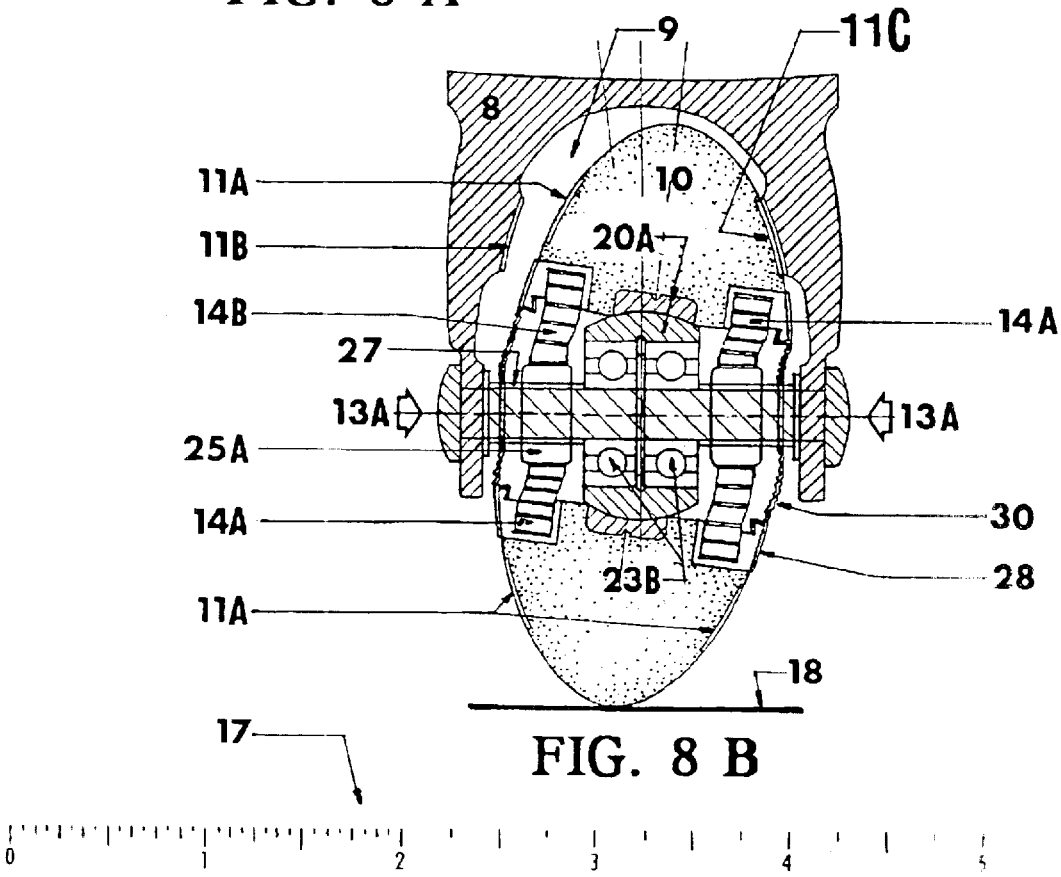
FIG. 8B is the same cross section view of FIG. 8A, except that the wheel is displayed in the EDGING FRICTION CONTROL™ position.

FIG. 8B is the same cross section view of FIG. 8A, except that parabolic wheel 10 is in the inclined EDGING FRICTION CONTROL™ position 11C and the opposite reacting self-aligning springs 24 in compression 14A and tension 14B, are set to return wheel 10 to the vertical coasting position as soon as edging force is released.

Figure 9A:
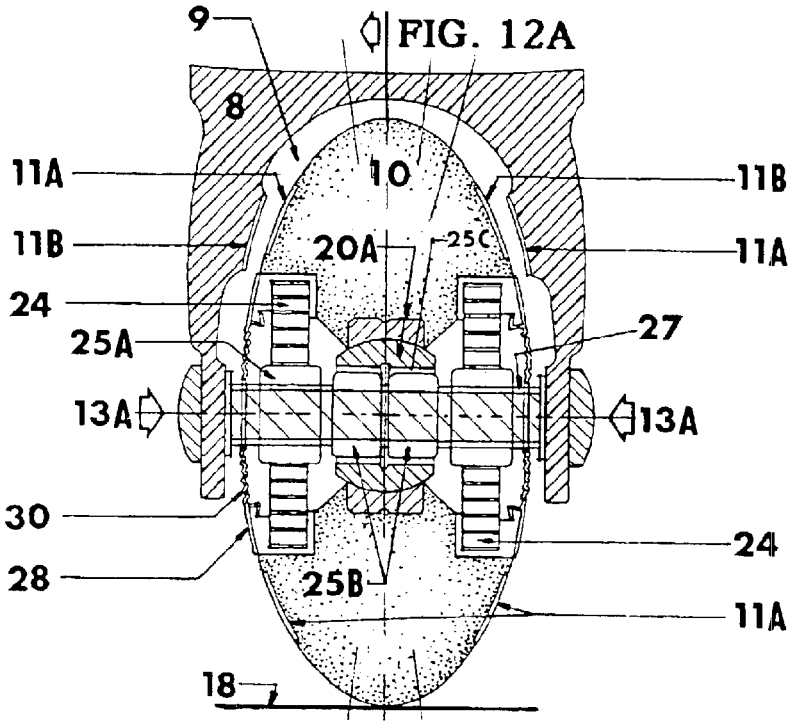
FIG. 9A is the third resolved cross section view (drawn to scale) in accordance with the invention of a wheel frame and wheel (in a coasting position), using the next smaller stock sized dynamic 2-element spherical bearing wheel hub, having a smaller bore size that will accommodate e.g. stock sized novel use 7⁄16"–½" O.D. needle roller axle bearings and using open coil self-aligning springs.

FIG. 9A is the third resolved cross section view in accordance with the invention (drawn to a graphic scale 17 in inches) of wheel frame 8 and wheel 10 (in a vertical coasting position), using the next smaller stock sized 2-element spherical bearing wheel hub 20A, having a smaller bore size that will accommodate e.g. stock sized novel use 7⁄16"–½" O.D. need roller axle bearings 25B. All other component parts remain the same in kind, use and size as shown in FIGS. 7A and 8A.

Figure 9B:
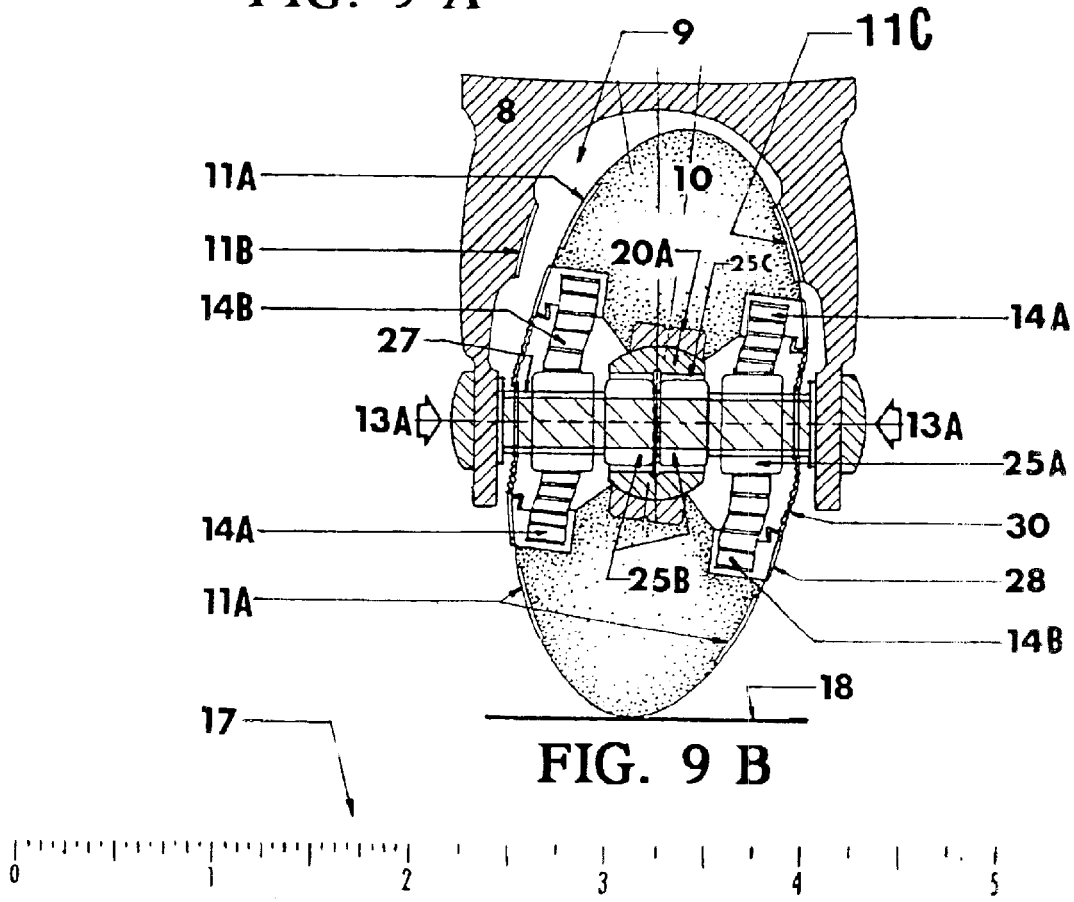
FIG. 9B is the same cross section view of FIG. 9A, except that the wheel is displayed in the EDGING FRICTION CONTROL™ position.

FIG. 9B is the same cross section view of FIG. 9A, except that parabolic wheel 10 is in the inclined EDGING FRICTION CONTROL™ position 11C and the opposite reacting self-aligning springs 24 in compression 14A and tension 14B, are set to return wheel 10 to the vertical coasting position as soon as edging force is released.

Figure 10A:
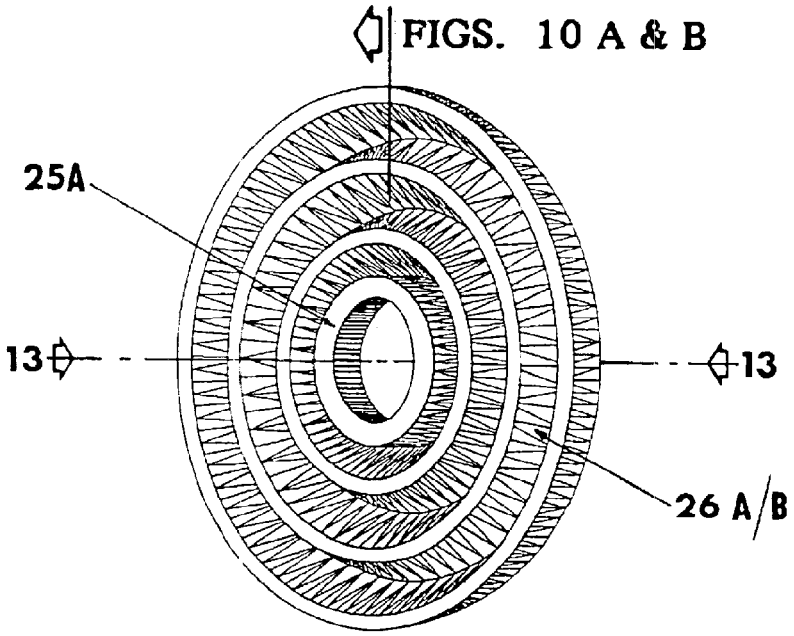
FIG. 10A is a dual appearing perspective view in accordance with the invention, depicting both a constant force, accordion pleated sheet alloy and (similarly appearing) accordion pleated reinforced rubberized self-aligning spring/dust cover.

FIG. 10A dual appearing perspective view in accordance with the invention, depicting both a constant force, accordion pleated sheet alloy self-aligning spring/dust cover 26A or the similarly appearing accordion pleated reinforced rubberized self-aligning spring/dust cover 26B. As indicated, at the core of the accordion pleated self-aligning spring is a needle roller axle bearing 25A.

Figure 10B:
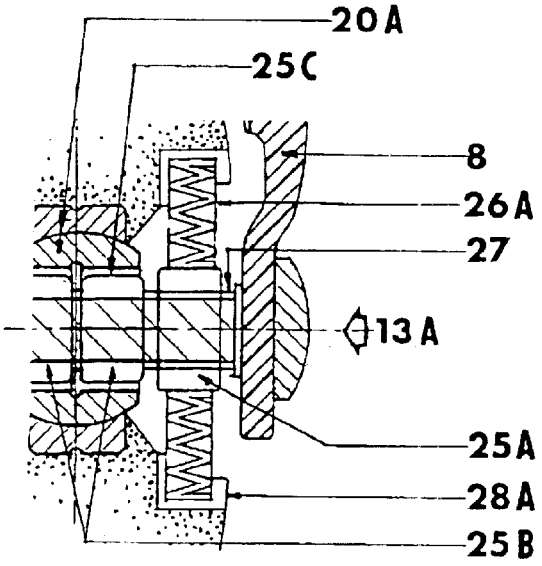
FIG. 10B is a partial cross section view specifically of the accordion pleated sheet alloy self-aligning spring/dust cover of FIG. 10A (also showing related partial wheel, hub, frame and axle parts)

FIG. 10B is a partial cross section view specifically of the accordion pleated sheet alloy self-aligning spring/dust cover 26A and related partial section views of: wheel frame 8; concave frame and retainer 28A for spring/dust cover 26A; needle roller axle for 26A; spherical bearing hub 20A; needle roller bearings 25B; axle sleeve spacer 27; and, axle screw and axle 13A.

Figure 10C:
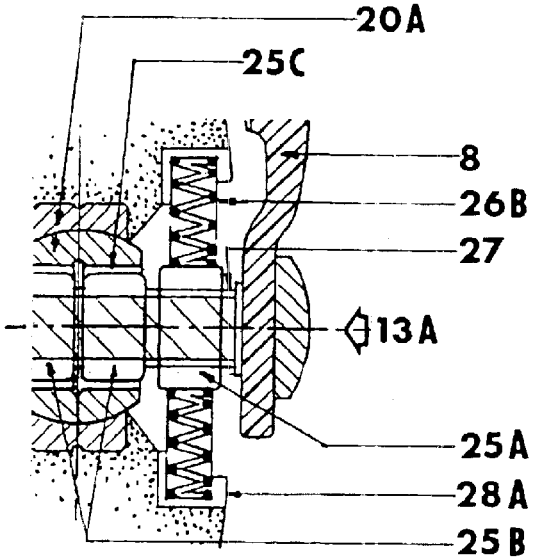
FIG. 10C is a partial cross section view specifically of the accordion pleated reinforced rubberized self-aligning spring/dust cover of FIG. 10A (also showing related partial wheel, hub, frame and axle parts)

FIG. 10C is the same cross section view as FIG. 10B, except that the self-aligning spring indicated is the accordion pleated reinforced composition type spring 26B.

Figure 11A:
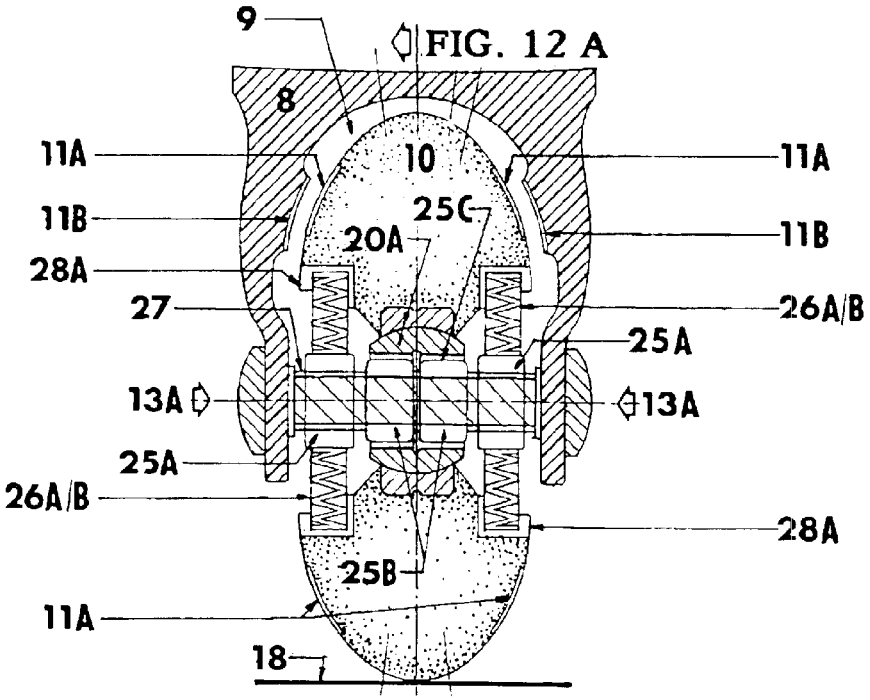
FIG. 11A is the fourth resolved cross section view (drawn to scale) in accordance with the invention of a wheel frame and wheel (in a coasting position), using the same smaller stock sized dynamic 2-element spherical bearing wheel hub used in FIGS. 9A & B, having the same smaller bore size that will accommodate e.g. stock sized novel use 7⁄16"–½" O.D. needle roller axle bearings and using an accordion pleated sheet alloy or reinforced rubberized self-aligning springs.

FIG. 11A is the fourth resolved cross section view in accordance with the invention (drawn to a graphic scale 17 in inches) of wheel frame 8, wheel-well 9 and wheel 10 (in a vertical coasting position), using the same smaller stock sized 2-element spherical bearing wheel hub 20A and and having the same size needle roller axle bearings 25B as used and shown in FIG. 9. The prime difference of the cross section view of FIG. 11A as compared to FIG. 9A is that, self-aligning spring 26A/B is a dual purpose accordion pleated spring/dust cover, as compared to to the open coil spring and separate entity dust cover of FIG. 9A. As such, concave frame 28A and wheel 10 are marginally different in form than those similar components as shown in FIG. 9A.

Figure 11B:
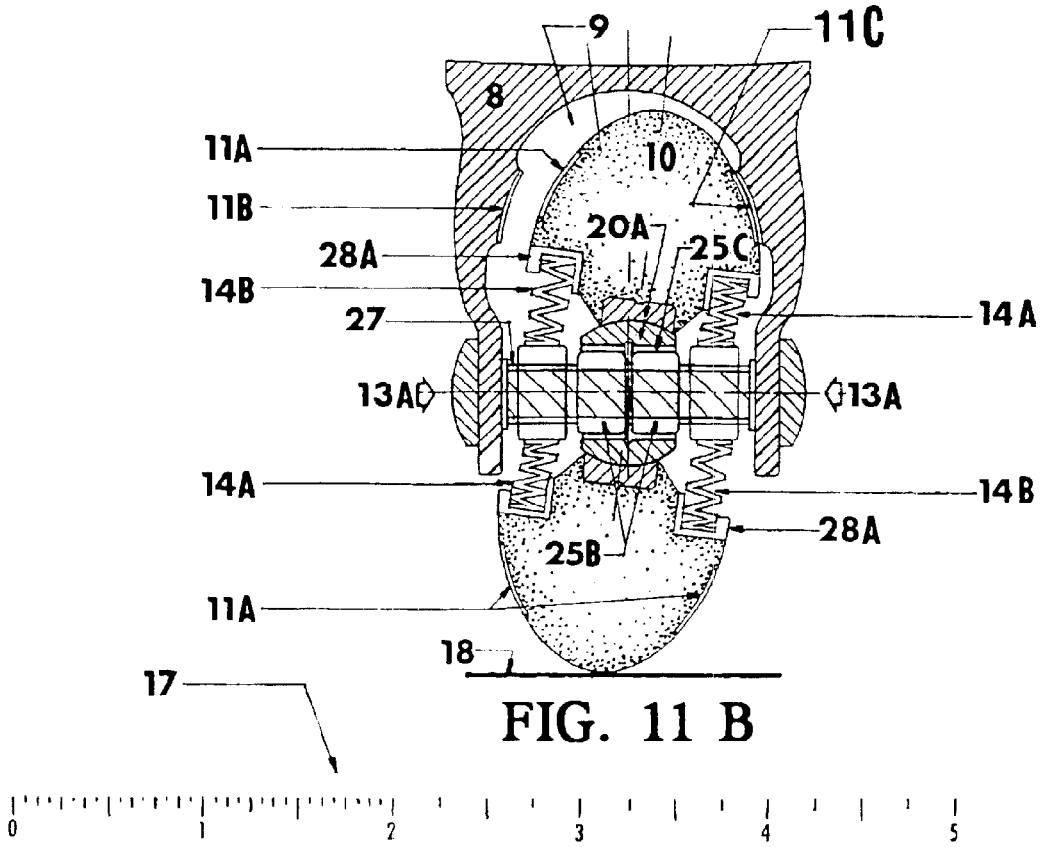
FIG. 11B is the same cross section view of FIG. 11A, except that the wheel is displayed in the EDGING FRICTION CONTROL™ position.

FIG. 11B is the same cross section view of FIG. 11A, except that wheel 10 is in the inclined EDGING FRICTION CONTROL™ position 11C and the opposite reacting self-aligning springs 26A/B in compression 14A and tension 14B, are set to return wheel 10 to the vertical coasting position as soon as edging force is released.

FIG. 12A is a longitudinal section view of FIG. 11A in accordance with the invention (drawn to a graphic scale 17 in inches) wherein all the identified components are identical to those identified in 11A and wherein the wheel 10 is displayed in the vertical coasting position.

FIG. 12B is a plan cross section view of FIG. 12A in accordance with the invention (drawn to a graphic scale 17 in inches), wherein all the identified components are identical to those in FIGS. 11A and 12A.

Figure 13A:
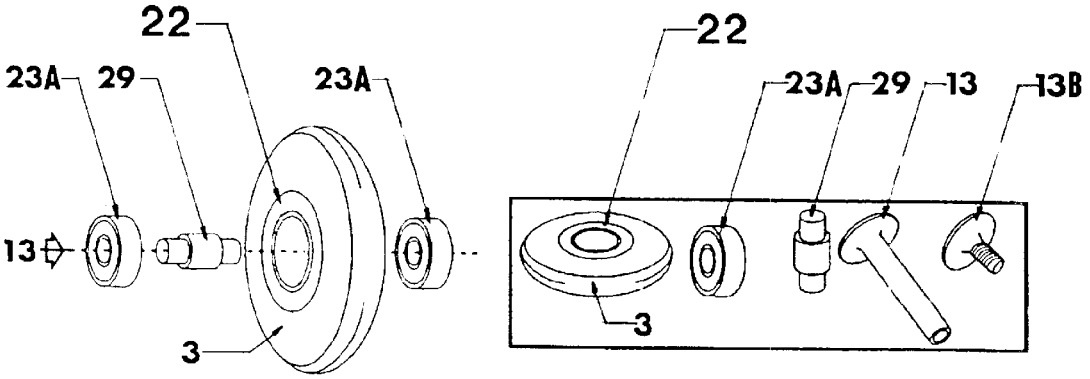
FIG. 13A is a perspective view illustrating the typical in-line skate, state of the art wheel assembly parts.

FIG. 13A is a composite view, illustrating the typical in-line skate, state of the art wheel assembly component parts. The state of the art wheel frame and boot, previously indicated in FIG. 1A (with particular emphasis to the boot and heel pad brake) is not indicated, since it is not relevant to this wheel assembly illustration. The parts indicated and identified are: the standard ¼" O.D. axle 13; axle screw 13B; roller ball bearing 23A (each symmetrical side of the single element, fixed, rigid hub 22); industry standard, reducing sleeve spacer 29 (to accommodate different I.D. parts to the standard ¼" O.D. axle); and, standard in-line skate wheel 3 (wherein the sides of wheel 3 are in one plane and the integral, single element, rigid hub 22 is flush with the flat sides of the finished wheel 3.

Figure 13B:
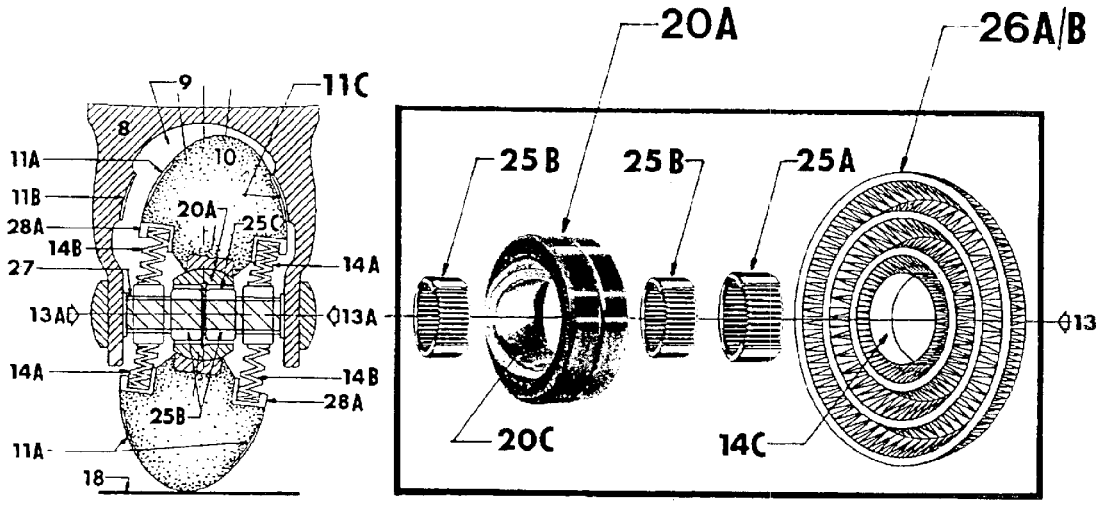
FIG. 13B is a composite illustration of a reduced typical cross section view of the interactive wheel to the frame's wheel well variation solution in accordance with the invention and a clarifying perspective view of the cross section's embodiment axle assembly, in comparison to the state of the art wheel assembly parts similarly illustrated in FIG. 13A.

FIG. 13B is a composite illustration of reduced cross section view FIG. 11B of the interactive wheel to frame's wheel-well variation solution (all parts previously described in full size FIG. 11B with wheel 10 in the EDGING FRICTION CONTROL™ position 11C). Adjacent is a clarifying perspective view of the same wheel assembly component axle parts indicated in the cross section. The wheel axle parts are arranged below FIG. 13A on the same sheet for ease of comparison to the state of the art. The parts illustrated are primarily on one symmetrical side of the dynamic 2-element spherical bearing hub 20A. For simplicity of illustration, the bore 20C (of the inner ring) or hub of the spherical bearing is neither in a vertical nor an inclined angular position, but rather in an assembly, pictorial position. In sequence, the wheel assembly parts are: needle roller axle hub bearing 25B (to the left of the symmetrical hub); dynamic spherical bearing hub 20A; needle roller axle hub bearing 25B; needle roller axle bearing 25A for core 20C of accordion pleated self-aligning spring 26A/B; and, wheel axle 13.

FIG. 14A is a cross section view of a novel dual purpose spherical bearing 32 used for the hub of in-line skates (drawn to a graphic scale 17 in inches) in accordance with the invention. Instead of having external, separate entity self-aligning springs e.g. 26A/B the spring 36 or 36A would be an integral part of the spherical bearing 32. Enclosed within an evenly split circular channel shaped void 33, one half within the inner concave surface of the outer ring 33A and one half within the convex surface of the inner ring 33B of the spherical bearing 32, would be a self-lubricated compression spring e.g. 36 or 36A. When the spherical bearing rings 32A and B are in a vertically aligned position (as are the split circular channel shapes), the enclosed compression spring 36/36A would be in a designed minimal dynamic force state 34.

FIG. 14B is the same cross section view of FIG. 14A, except that the outer ring 32A is in an inclined angular position and the split circular channels become misaligned. At maximum inclination, the compression spring 36 or 36A is also in a maximum dynamic force state. As a result, when the skate wheel 31 rotates, the compression spring 36 or 36A of the dual purpose spherical bearing hub is in a constant state of equal and opposite, compressive self-aligning forces.

FIG. 14C is a longitudinal view of FIG. 14A.

Figure 14:
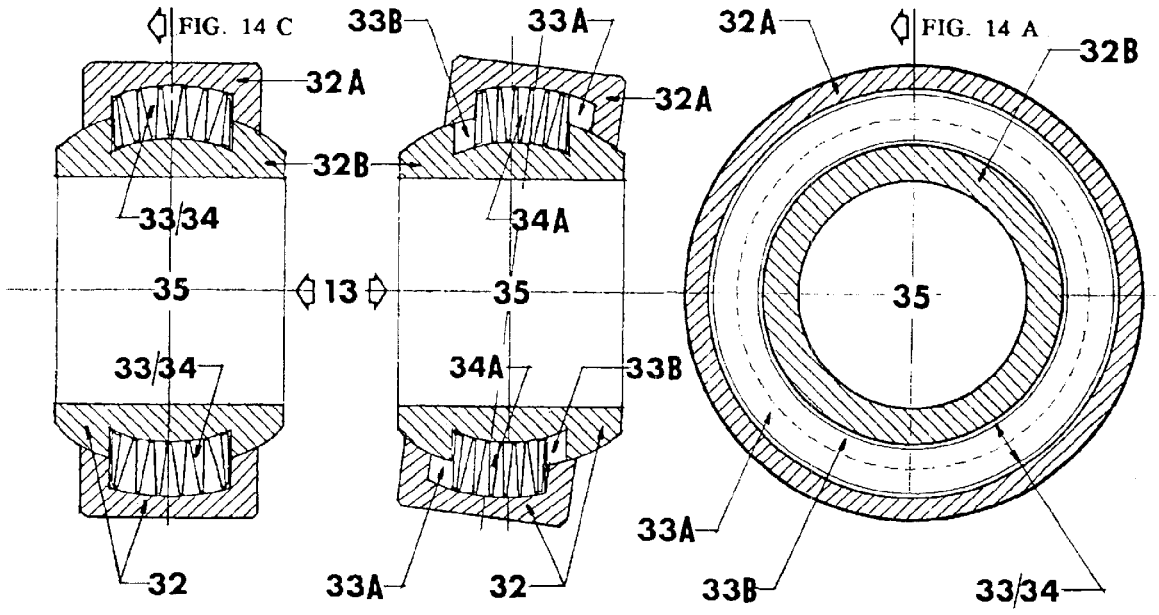
FIG. 14A is a cross section view of a novel spherical bearing (drawn to scale) in accordance with the invention that has an integral self-aligning spring in a minimal dynamic force state.
FIG. 14B is the same cross section view of FIG. 14A, except that the outer and inner rings of the spherical bearing are in a misaligned and maximum dynamic EDGING CONTROL™ state.
FIG. 14C is a longitudinal section view of FIG. 14A.
FIG. 14D is a perspective view in accordance with the invention of a self-lubricated accordion pleated sheet alloy or urethane compression self-aligning spring as shown in FIGS. A & B.
FIG. 14E is a perspective view in accordance with the invention of a self-lubricated wire coil compression self-aligning spring as similarly shown in FIGS. 14A & B.
Figure 14D:
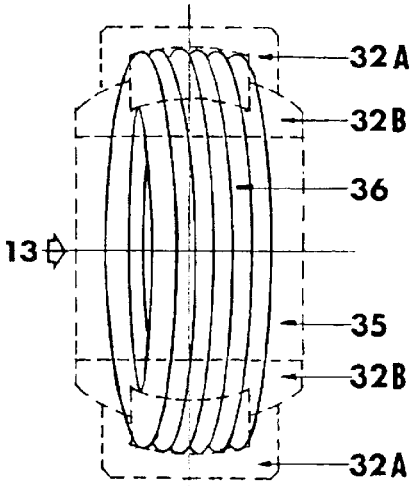

FIG. 14D is a perspective view of a self-lubricated accordion pleated sheet alloy or urethane compression spring 36 in a minimal dynamic force state 34.

Figure 14E:
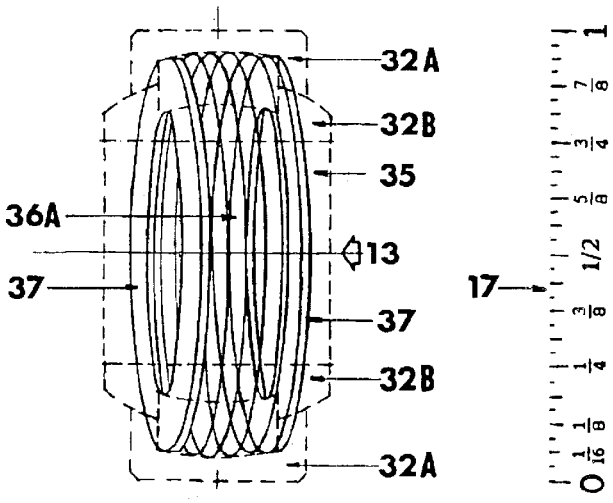

FIG. 14E is a perspective view of a self-lubricated wire coil compression spring 36A in a minimal dynamic force state 34.

Figure 15A:
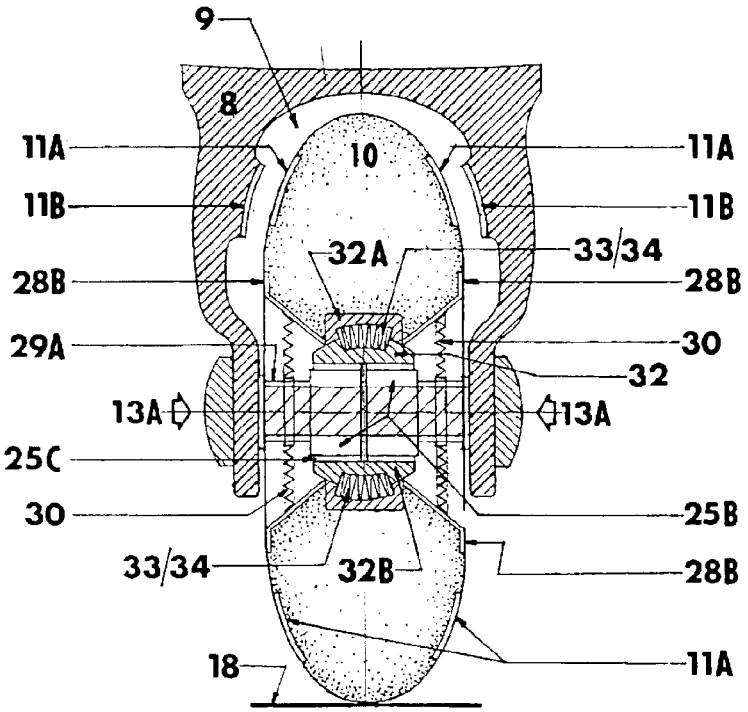
FIG. 15A is the fifth resolved cross section view (drawn to scale) in accordance with the invention of a wheel frame and wheel (in a coasting mode), using a similar small sized dynamic 2-element spherical bearing wheel hub as used in FIGS. 9A & B and FIGS. 11A & B but is distinct in the use of a dual purpose 2-element spherical bearing, having an integral self-aligning spring (eliminating external springs) and still accommodating e.g. stock sized novel use 7⁄16"–½" O.D. needle roller axle bearings.

FIG. 15A is the fifth resolved cross section view in accordance with the invention (drawn to graphic scale in inches) of a wheel frame 8, wheel-well 9 and wheel 10 (in a vertical coasting position), using the same smaller stock sized 2-element spherical bearing wheel hub 20A and the same size needle roller axle bearings 25B, as used in FIG. 9A and FIG. 11A. The prime difference of this cross section view FIG. 15A as compared to FIGS. 9A and 11A is that: instead of having separate entity, external self-aligning springs 14 or 26A/B, a dual purpose spherical bearing hub is used 32 with an integral self-aligning, self-lubricated spring 36 or 36A; and, an accordion pleated dust cover with a self-lubricated collar 30.

Figure 15B:
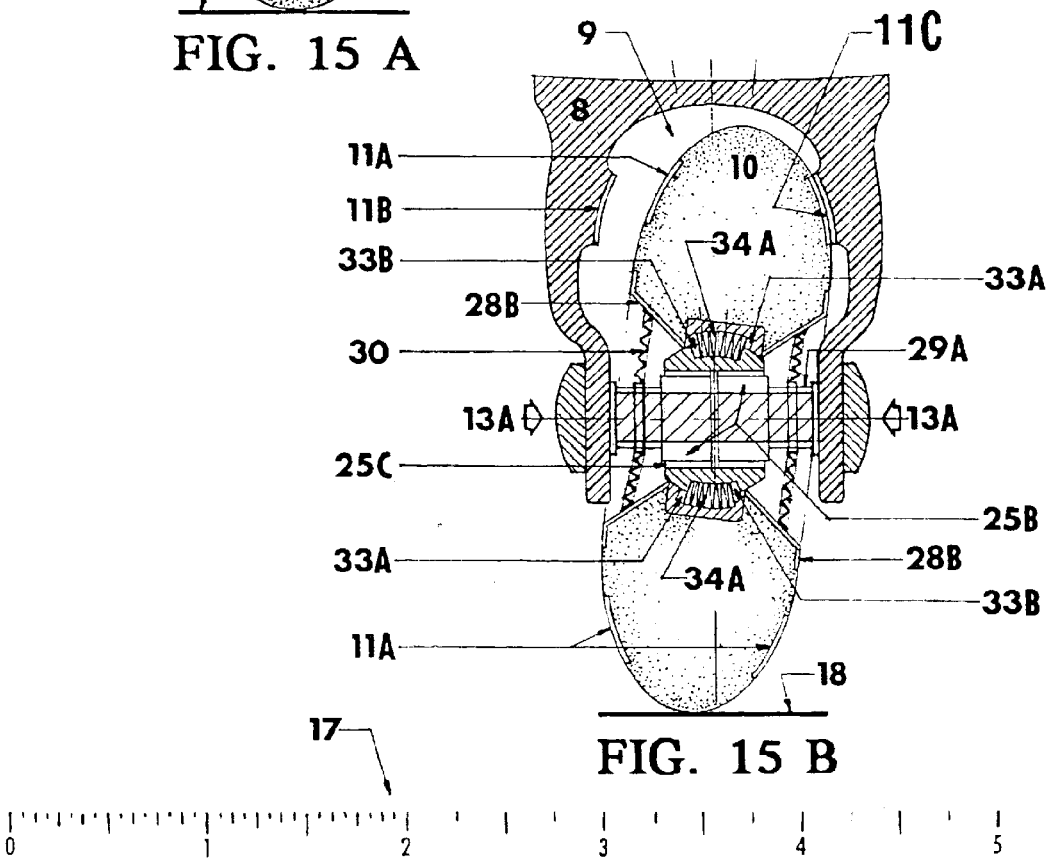
FIG. 15B is the same cross section view of FIG. 15A, except that the wheel is displayed in the EDGING FRICTION CONTROL™ position.

FIG. 15B is the same cross section view of FIG. 15A, except that wheel 10 is in the inclined EDGING FRICTION CONTROL™ position 11C and the equal and opposite reacting self-aligning compression spring 34A is set (in that maximum compressive state) to return wheel 10 to the vertical position as soon as edging force is released.

Figures 16A, 16B:
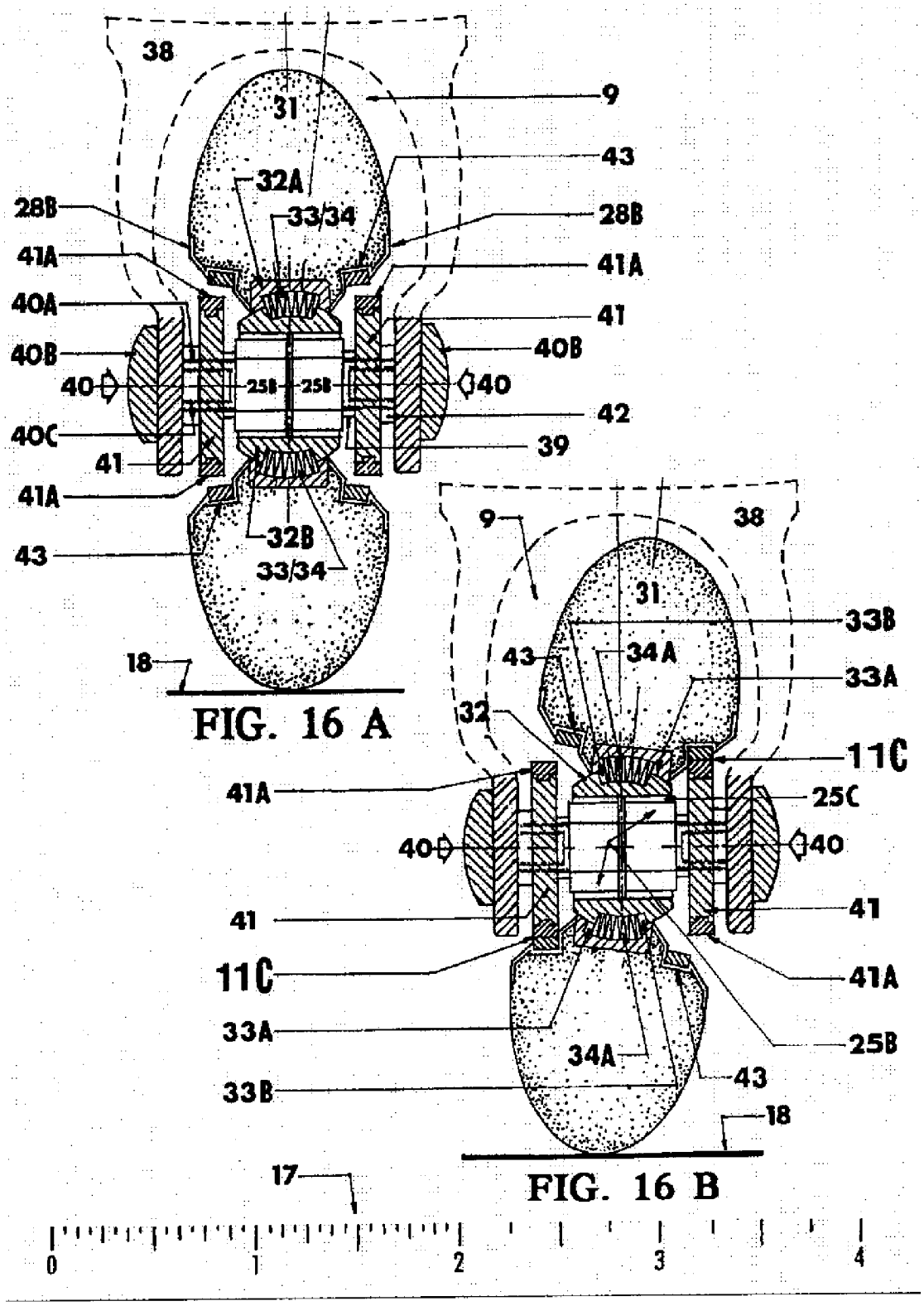
FIG. 16A is the sixth resolved cross section view (drawn to scale) in accordance with the invention as a variation solution, wherein the EDGING FRICTION CONTROL™ contact locations are entirely self-contained within the wheel assembly components and wherein the wheel frame is not relevant to this variation solution (other than supporting the wheel assembly components and as such is indicated by broken lines) and wherein the wheel is displayed in a coasting position.
FIG. 16B is the same cross section view of FIG. 16A, except that the wheel is displayed in the EDGING FRICTION CONTROL™ position.
Figure 17:
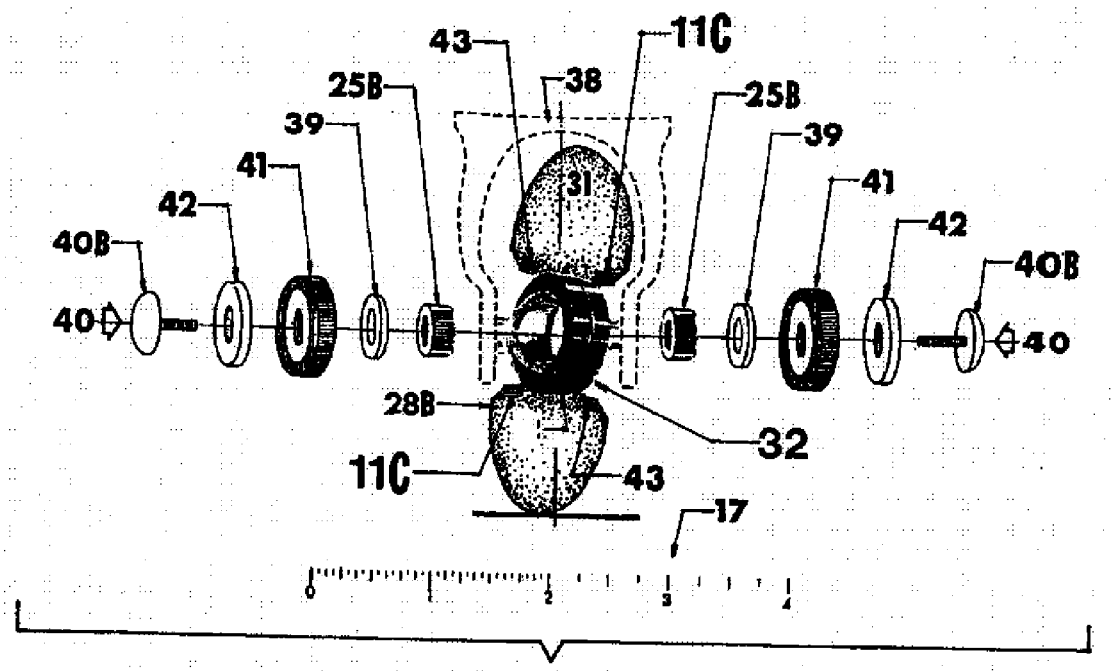
Figure 20A:
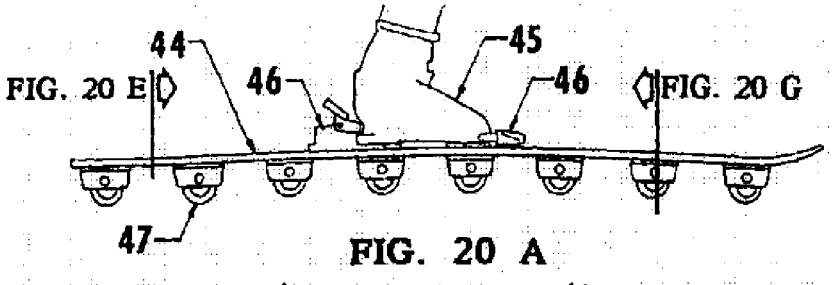
Figure 20B:
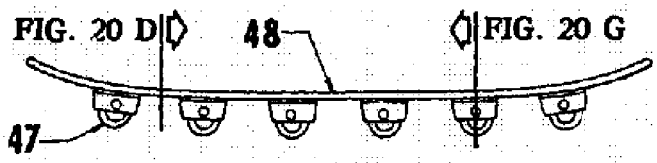
Figure 20C:
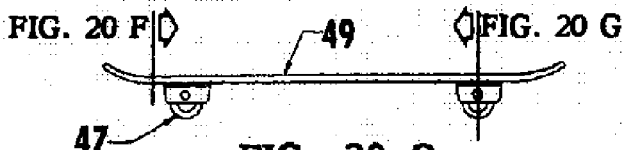
Figure 20D:
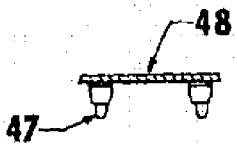
Figure 20E:
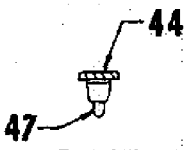
Figure 20F:
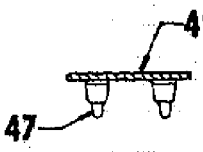
Figure 20G:
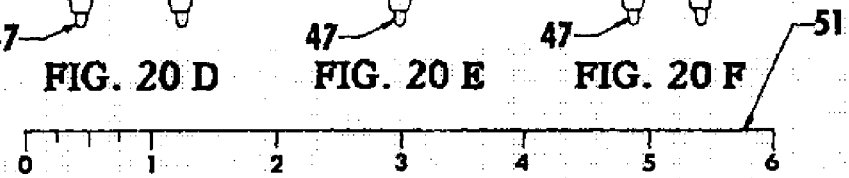
Figure 20G:
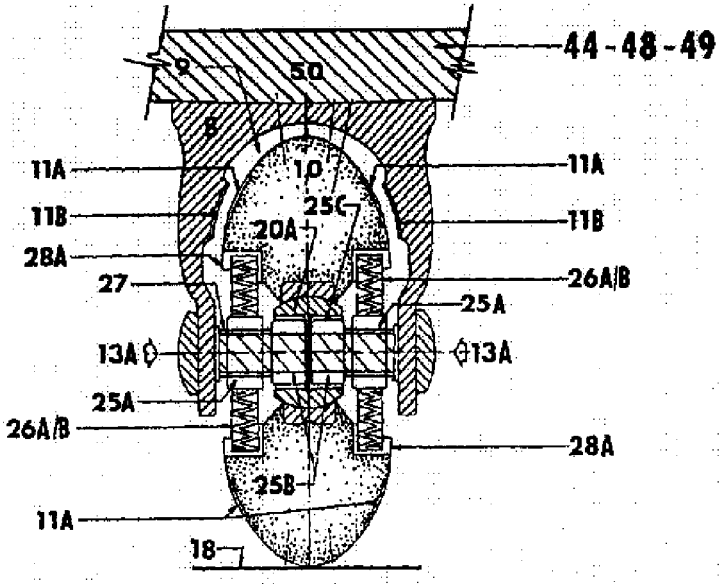

FIG. 16A is the sixth resolved cross section view (drawn to a graphic scale 17 in inches) in accordance with the invention as an alternate variation solution, wherein the EDGING FRICTION CONTROL™ contact locations 11C are entirely self-contained within the wheel assembly components. As such, the wheel frame 38, not being relevant to this variation solution (other than supporting the wheel assembly components), is indicated by broken lines. This alternate variation solution uses the same dual purpose, spherical bearing hub 32 and needle roller axle bearings 25B as shown in FIG. 15A. In this variation solution, the standard ¼" O.D. axle is modified 40 by being fine threaded (e.g. ¼-28) on the surface 40A from each end of the axle to the outside faces of the hub axle bearings 25B. Inside fine threads (e.g. 8–32) 40C are set into each end of axle 40 to receive cap screws 40B. A solid disk (e.g. ⅛" W.×27/32" O.D.) 41 with a center core that is fine threaded (e.g. ¼-28) is screwed onto the axle 40 against washer spacer 39, which is against hub axle bearing 25B. On the other side of disk 41, is a locknut spacer (e.g. ¼-28 threaded fineal nut) that is screwed onto axle 40 against the solid disk 41, locking it in place. On the other side of the fineal locknut is wheel frame 38. The assembly at that symmetrical end side is completed by the installation of axle cap screw 40B. Disk 41 has a friction surface material 41A (e.g. ⅛" Wide×3/32" Thick) bonded and keyed into the perimeter of the disk (now named, "friction disk") 41A. Wheel 31 has a concave frame 28B with a continuous indentation for a bonded friction band, surface material 43 (e.g. ⅛" Wide×3/32" Thick). When the wheel 31 is in a vertical coasting position, the diameter of the friction disk 41 is such that there is designed clearance between the friction disk's perimeter surface and the concave frame's 28B indented friction surface 43.

FIG. 16B is the same cross section view of FIG. 16A, except that wheel 31 is in the inclined EDGING FRICTION CONTROL™ position 11C at two simultaneously responsive locations: one friction contact 11C is at the top of the friction disk's perimeter 41 and the wheel frame's indented friction band 43 on one side and simultaneously at the bottom of the friction disk's perimeter and the wheel frame's indented friction band 43 on the opposite friction contact side 11C. In that inclined EDGING FRICTION CONTROL™ position, the integral self-aligning spring 34A of dual purpose spherical bearing hub 32 are in an equal and opposite maximum compressive strength state and set to return wheel 31 to the vertical coasting position as soon as the edging force is released. All the remaining interrelated component parts are identical to those that have been identified and functionally described in FIG. 16A.

FIG. 13A is a duplication of a composite perspective view, illustrating the typical in-line skate, state of the art wheel assembly component parts to clarify the distinct differences of the self-contained wheel assembly, alternate variation solution in accordance with the invention as compared to the state of the art. The duplicated parts displayed are: the standard ¼" O.D. axle 13; axle screw 13B; roller ball axle bearing 23A (each symmetrical side of the single element, fixed, rigid hub 22); industry standard, reducing sleeve spacer 29 (to accommodate different I.D. parts to the standard ¼" O.D. axle); and, standard in-line skate wheel 3, wherein the sides of wheel 3 are in one plane and the integral, single element, rigid hub 22 is flush with the flat sides of the finished wheel.

Figure 17:
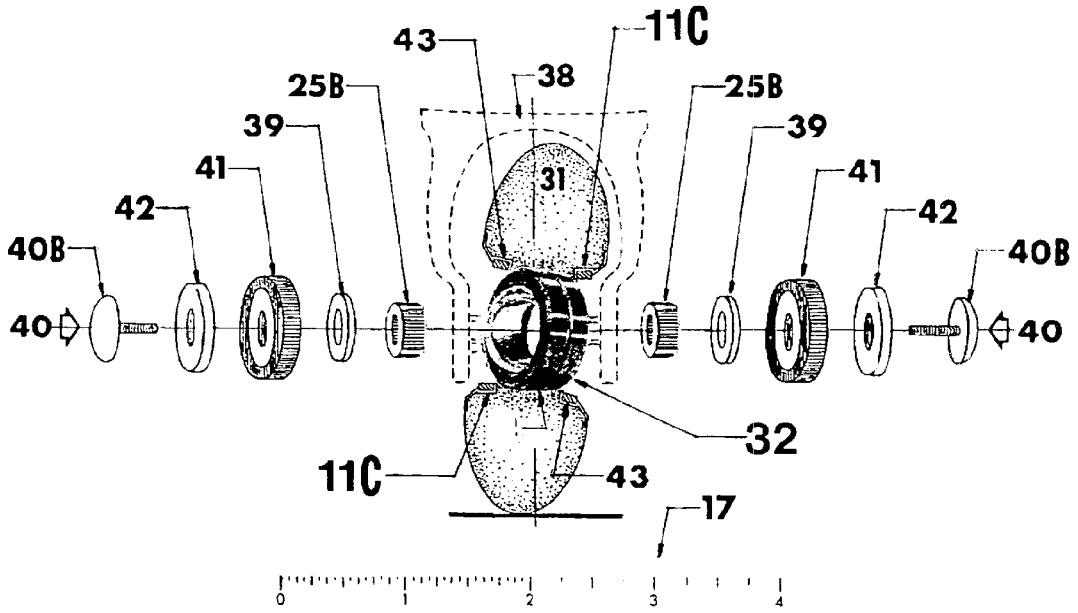
FIG. 17 is a perspective view illustrating the embodiment parts of the self-contained wheel assembly variation solution in accordance with the invention.

FIG. 17 is a perspective view of the component parts of the self-contained wheel assembly, alternate variation solution, in accordance with the invention and as shown in cross section views 16A and B. The indicated and identified components are: modified standard ¼" O.D. axle 40; modified thread size, standard axle cap screw B; locknut 42; fixed friction disk 41; washer spacer 39; needle roller axle bearing 25B; indentation for continuous friction band 43 in concave frame 28B of wheel 31; novel dual purpose, dynamic 2-element spherical bearing wheel hub; broken line indication of conforming but non-functioning in-line skate frame; and, graphic scale 17 in inches.

Figures 18A, 18B:
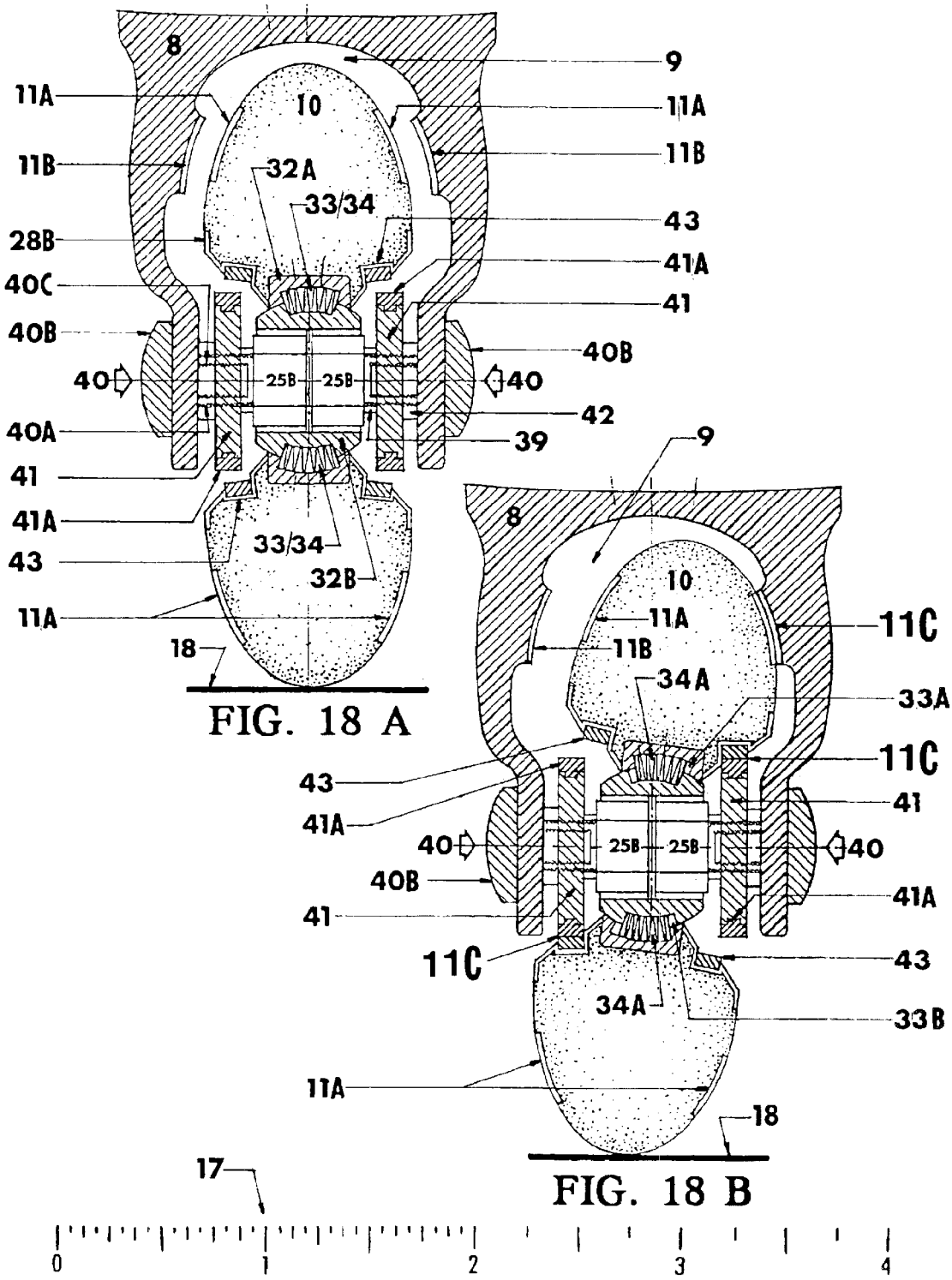
FIG. 18A is the seventh resolved cross section view (drawn to scale) in accordance with the invention wherein the EDGING FRICTION CONTROL™ is augmented by combining the interactive wheel to the wheel well of the frame, friction contact variation solution (as shown in FIGS. 15A & B) with the self-contained wheel assembly solution (as shown in FIGS. 16A & 16B.), wherein the wheel is displayed in a coasting position.
FIG. 18B is the same cross section view of FIG. 18 A, except that the wheel is displayed in the EDGING FRICTION CONTROL™ position.

FIG. 18A is the seventh resolved cross section view (drawn to a graphic scale 17 in inches) in accordance with the invention as an alternate variation solution, wherein two progressive alternate solutions are combined: the interactive wheel to frame's wheel-well alternate solution as illustrated in FIGS. 15A and B; and, the self-contained wheel assembly alternate solution as illustrated in FIGS. 16A and B. These conjoined solutions would consist of: wheel frame 8 and wheel-well 9 with friction strips 11B; wheel 10 (in a vertical coasting position), having friction bands 11A on its sides; an indentation in concave frame 23B for continuous friction band surface 43; and, including the complete self-contained wheel assembly 61 components in accordance with the invention and as indicated and described in perspective view FIG. 17 (wherein the 2-element dual purpose spherical bearing hub 32 is used).

FIG. 18B is the same cross section view of FIG. 18A, except that wheel 10 is in an inclined EDGING FRICTION CONTROL™ position, which in this conjoined variation solution of FIG. 18 achieves three EDGING FRICTION CONTROL™ 11C contact locations: one between the wheel's 31B friction band 11A and the wheel well's 9 friction strip 11B; and, two between the friction disk's 41 perimeter friction surface 41A and the indented friction band surface 43 in concave frame 28B (at the top of the disk's perimeter 41A on one side and the bottom of the disk's perimeter 41A on the opposite side).

Figure 19A:
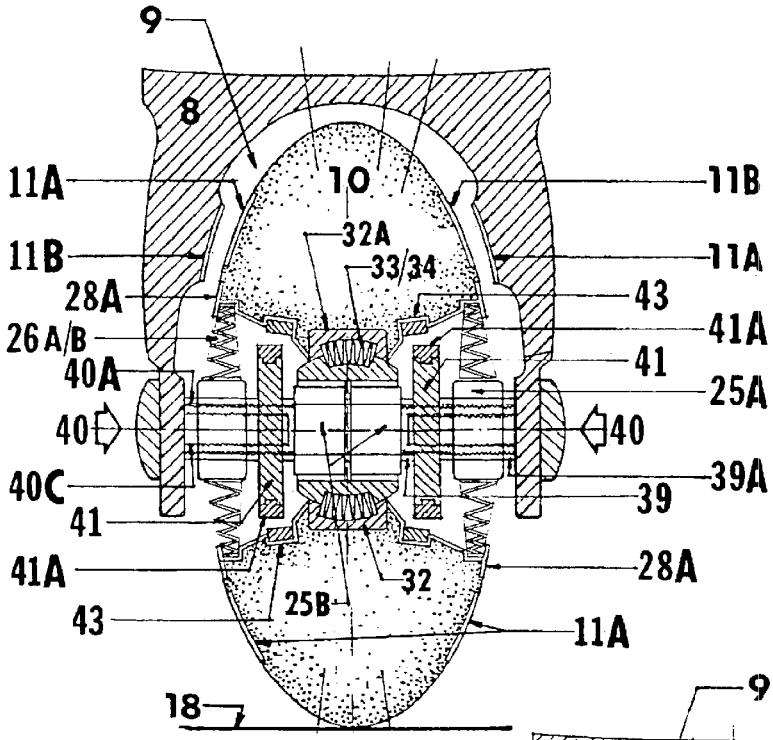
FIG. 19A is the eighth resolved cross section view (drawn to scale) in accordance with the invention, wherein the combined variation solution illustrated in FIGS. 18A & B, having an internal self-aligning spring within the novel dual purpose spherical bearing hub, has that alignment function augmented by the addition of external self-aligning springs, providing maximum strength and rapid response to that self-alignment function.

FIG. 19A is the eighth resolved cross section view (drawn to a graphic scale 17 in inches) in accordance with the invention with wheel 10 in a vertical coasting position. As a culminating alternate variation this solution is based upon the combined resolution as detailed in FIGS. 18A and B. This resulting final combination was achieved by resurrecting the previously ignored external self-aligning springs 26A and 26B. Adding those external springs in conjunction with the integral self-aligning spring of the dual purpose spherical bearing hub 32, creates an all encompassing solution that has three EDGING FRICTION CONTROL™ contact locations 11C (as in FIGS. 18A and B); plus the combined enhanced force of two distinct self-aligning spring functional locations. The combined self-aligning springs not only maximize the force to initiate EDGING FRICTION CONTROL™ but equally maximizes the rapid responsiveness in returning wheel 10 back to the vertical coasting position. Other than the incremental additional inside face to face width at the axle location of frame 8 (allowing for the external springs), this cross section FIG. 19A has the same conjoined components as indicated and identified in FIG. 18A with the additional exception of fineal nut 42. That locknut is replaced by an inside threaded alloy sleeve 39A (e.g. ¼-28) that matches the surface threads 40A on the ¼" O.D. axle 40. The smooth outside surface sleeve serves a dual purpose. It provides the required minimal friction surface for the needle roller axle bearing core of the self-aligning spring 26A/B (which bearing has required axle play on each side). In addition, when the sleeve is screwed tight against friction disk 41 to lock it in place, sleeve 39A serves the same purpose as fineal nut 42 as shown in FIG. 18A.

Figure 19B:
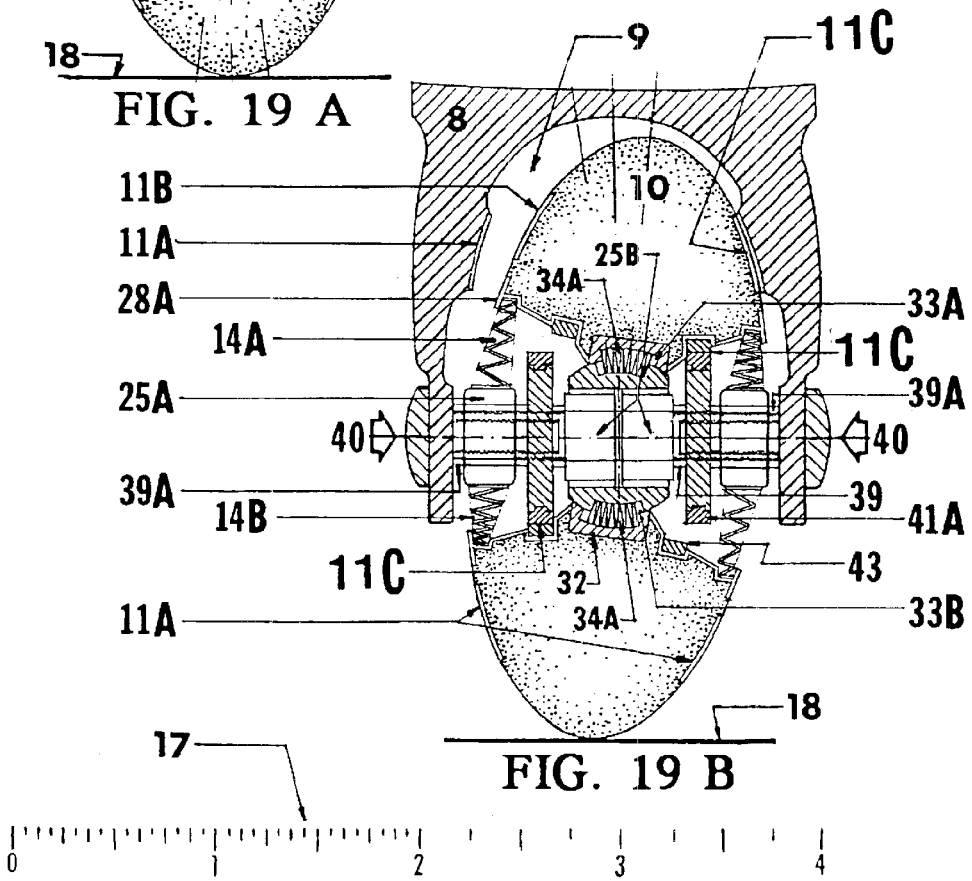
FIG. 19B is the same cross section view of FIG. 19A, except that the wheel is displayed in the EDGING FRICTION CONTROL™ position.

FIG. 19B is the same cross section view of FIG. 19A, except that wheel 10 is in an inclined EDGING FRICTION CONTROL™ position providing three simultaneous contact locations 11C as indicated 11C at each friction disk's perimeter 41A (top and bottom of friction disk 41 on each side of the axle assembly) and between the friction band surface 11A on wheel 10 and the friction strip surface 11B on the inside face of wheel-well 9.

Figure 20A:
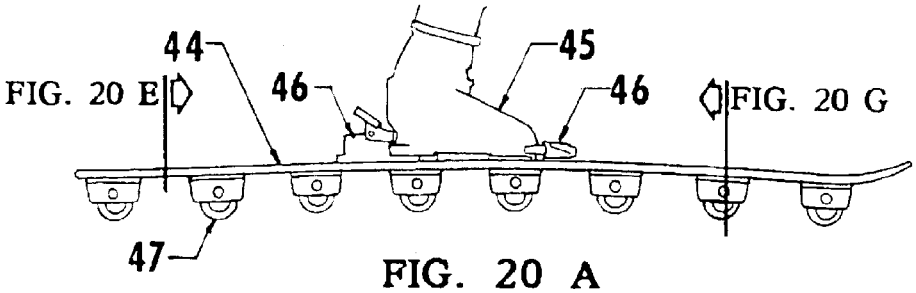
FIG. 20A is a side elevation view of a downhill in-line ski (drawn to scale) in accordance with the invention, wherein a plurality of the wheeled device is attached to a conforming conventional snow ski for warm weather downhill in-line skiing on grass or other simulated surface.

FIG. 20A is a side elevation view (drawn to a graphic scale 51 in feet) of a downhill in-line ski 44 having a plurality of wheel assembly devices 47 in accordance with the invention. Also indicated for illustration purposes is ski boot 45 with release binding 46.

Figure 20B:
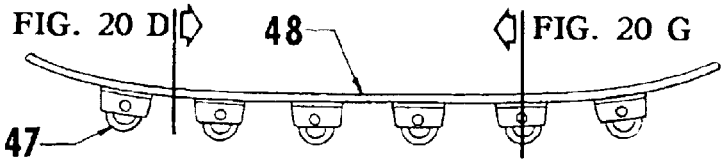
FIG. 20B is a side elevation view of a downhill in-line skateboard (drawn to scale) in accordance with the invention, wherein a plurality of the wheeled device is attached to a conforming conventional snowboard for warm weather downhill in-line skateboarding on grass or other simulated surface.

FIG. 20B is a side elevation view (drawn to a graphic scale 51 in feet) of a downhill in-line skateboard 48 having a plurality of wheel assembly devices 47 in accordance with the invention.

Figure 20C:
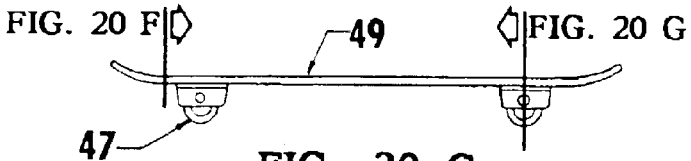
FIG. 20C is a side elevation view of an in-line skateboard (drawn to scale) in accordance with the invention, wherein a plurality of the wheeled device is attached to a conventional skateboard, providing the additional safety feature of EDGING FRICTION CONTROL™.

FIG. 20C is a side elevation view (drawn to a graphic scale 51 in feet) of an in-line skateboard having a plurality of wheel assembly devices 47 in accordance with the invention.

Figure 20D:
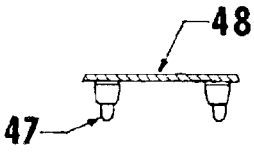
FIG. 20D is a cross section view of FIG. 20B in accordance with the invention.

FIG. 20D is a cross section view of FIG. 20B (drawn to a graphic scale 51 in feet).

Figure 20E:
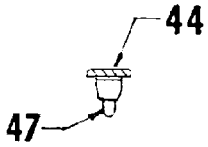
FIG. 20E is a cross section view of FIG. 20A in accordance with the invention.
Figure 20F:
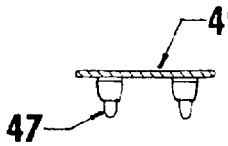
FIG. 20F is a cross section view of FIG. 20C in accordance with the invention.

FIG. 20E is a cross section view of FIG. 20A (drawn to a graphic scale 51 in feet).

FIG. 20 F is a cross section view of FIG. 20C (drawn to a graphic scale 51 in feet).

Figure 20G:
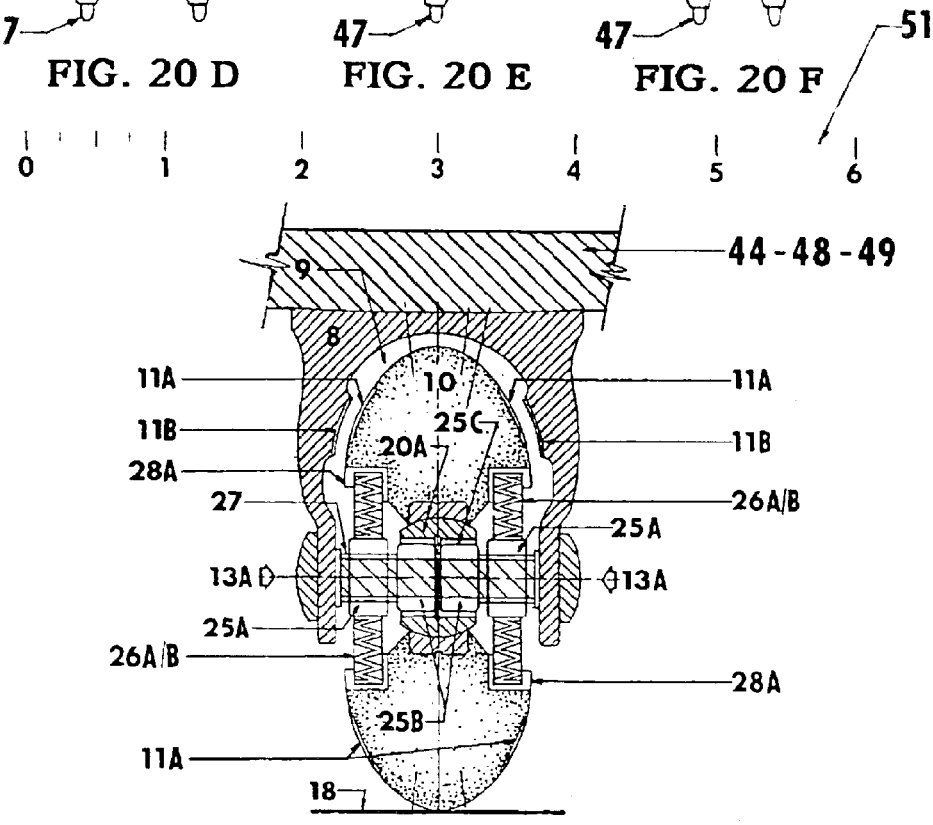
FIG. 20G is a composite representative cross section view of FIGS. 20A, 20B and 20C in accordance with the invention.

FIG. 20G is a representative cross section view of FIGS. 20A, 20B and 20C displaying the typical parts that comprise on of the alternate variation solutions of wheel assembly 47 in accordance with the invention.

While the invention and its alternate variation solutions has been particularly shown and described with reference to preferred embodiments thereof, it will be understood by those in the art that the foregoing and other changes in form and details may be made therein without departing from the spirit and scope of the invention. For example, the wheels described herein are not limited for use with in-line skates, in-line skateboards, downhill in-line skis, and downhill in-line skateboards, but may be used whenever both vertical and inclined rotation is required around an axle.

What is claimed is:

1. A spherical bearing assembly comprising:

an inner ring member defining a vertical axis and having a bore extending in a direction transverse with respect to the vertical axis;

an outer ring member mounted with respect to the inner ring to permit inclined rotation of outer ring with respect to the vertical axis; and, a spring structure constructed and arranged to bias the outer ring towards the vertical axis.

2. The bearing assembly of claim 1, wherein the spring structure comprises a compression spring between the inner and outer ring member.

3. The bearing assembly of claim 2, wherein said compression spring is one of a self-lubricated: wire coil spring; an accordion pleated sheet alloy spring; an accordion pleated reinforced sheet rubberized spring; and, a urethane compression spring.

4. A wheeled device comprising:

a wheel frame;

at least one wheel mounted on an axle associated with the wheel frame;

wherein said wheel is constructed and arranged to rotate around said axle with respect to a vertical axis and at inclinations in apposing directions about the vertical axis and spring structure constructed and arranged to bias the wheel in opposing directions toward the vertical axis.

5. The wheeled device as defined in claim 4, wherein said wheel is of generally a parabolic shape.

6. The wheeled device as defined in claim 5, wherein said wheel has concave depressions on each side of said wheel, providing clearance to allow inclined wheel rotation around said axle.

7. The wheeled device as defined in claim 6, wherein said wheel has concave depression frames.

8. The wheel device as defined in claim 7, wherein said concave depression frames have indentations to retain self-aligning springs to reposition an inclined wheel back into a vertical position.

9. The wheeled device as defined in claim 8, wherein said self-aligning springs are one of constant force open coil springs, accordion pleated sheet metal alloy springs, and accordion pleated reinforced rubberized springs, wherein the pleated springs are configured to serve a dual purpose as a dust cover.

10. The wheeled device as defined in claim 7, wherein said concave depression frames include means for securing a dust cover to the wheel.

11. The wheeled device as defined in claim 10, wherein a dust cover is coupled with the securing means and said dust cover is an accordion pleated rubberized component with a self-lubricated collar.

12. The wheeled device as defined in claim 4, wherein the wheel frame has a wheel-well contoured to compliment said wheel.

13. The wheeled device as defined in claim 4, wherein said wheel has a dynamic spherical bearing, having outer and inner rings, each ring being omnidirectional to each other, allowing said wheel to rotate both vertically and at an inclination and wherein said spherical bearing's inner ring has a concentric opening defining a bore.

14. The wheeled device as defined in claim 13, wherein the bore has at least one axle bearing therein that enables said wheel to rotate with minimal friction around said axle.

15. The wheeled device as defined in claim 14, wherein the axle bearing is one of a roller ball axle bearing and needle roller axle bearing.

16. The wheeled device as defined in claim 13, wherein said wheel has friction members on each side thereof.

17. The wheeled device defined in claim 16, wherein the wheel frame has a wheel-well and the wheel-well has a friction surface within opposite sides of said wheel-well.

18. The wheeled device as defined in claim 17, wherein said wheel, when rotating vertically has predetermined clearance between the friction members and said friction surfaces in said wheel-well.

19. The wheel device as defined in claim 17, wherein said wheel, when rotating at a certain inclination, has one friction member in contact with a friction surface of said wheel-well to cause slowing down and braking of said wheel.

20. The wheeled device as defined in claim 13, wherein said spherical bearing further includes an integral compression spring to bias the wheel towards vertical rotation thereof.

21. The wheeled device as defined in claim 4, wherein the wheel frame is attached to one of an in-line skate, an in-line skateboard, a downhill in-line ski and a downhill in-line skateboard.

22. A wheeled device comprising:

a wheel frame;

at least one wheel mounted on an axle for rotation with respect to the wheel frame;

the axle including friction contact surfaces;

the wheel including friction control surfaces; and, wherein the at least one wheel is constructed and arranged to rotate around the axle both vertically and at an inclination, such that when the wheel is at a certain inclination, the friction control surfaces of said wheel engage the friction contact surfaces of said axle to cause slowing down and braking of said wheel.

23. The wheeled device as defined in claim 22, wherein said wheel has concave depressions on each side of said wheel, providing clearance to allow inclined wheel rotation around said axle.

24. The wheeled device as defined in claim 23, wherein the wheel has concave depression frames.

25. The wheeled device as defined in claim 24, wherein the wheel has an indentation in said concave depression frames retaining a friction element defining the friction control surface.

26. The wheeled device as defined in claim 25, wherein said wheel includes a spherical bearing hub having an integral compression spring, thereby not only providing for inclined wheel position but also providing the added function of self-alignment of the wheel, thereby serving a dual purpose.

27. The wheeled device as defined in claim 26, further including at least one axle bearing in a bore of the spherical bearing hub that enables said wheel to rotate with minimal friction around said axle.

28. The wheeled device as defined in claim 27, wherein said axle bearing is one of a roller ball axle bearing and a needle roller axle bearing.

29. The wheeled device as defined in claim 27, wherein said axle is threaded on the outside surface at each end of said axle to an outside face thereof.

30. The wheeled device as defined in claim 29, wherein the axle has a washer spacer disposed over said axle at each end thereof.

31. The wheeled device of claim 30, wherein a round friction disk, with a center bore having inside threads that match the outside threads on the surface of said axle, is screwed onto said axle at each end and locked to said washer spacer.

32. The wheeled device as defined in claim 31, wherein said axle has inside threads set into each end of the axle to receive outside cap screws that are set tight against the outside face of said wheel frame, effectively double locking said friction disk securely in place to prevent it from turning.

33. The wheeled device as defined in claim 31, wherein said friction disk has a friction material on a perimeter thereof defining a friction contact surface.

34. The wheeled device as defined in claim 33, wherein when rotating vertically, said concave depression frame's friction element has predetermined clearance with respect to said friction disk's perimeter friction material.

35. The wheeled device as defined in claim 33, wherein when the wheel is rotating at an inclination, surfaces of the concave frame's friction element simultaneously contact with said friction material of the friction disk at two contact locations, one contact location being at the top of the friction disk at one side of the wheel and the other contact location being at the bottom of the friction disk at the opposite wheel side, and wherein realignment of said wheel to vertical rotation is achieved by the force of the integral compression spring.

36. The wheeled device as defined in claim 25, wherein said wheel has a friction surface material included on each side of said wheel.

37. The wheeled device as defined in claim 36, wherein the frame includes a wheel-well, the wheel-well having opposing friction surfaces arranged such that, when the wheel is rotating vertically, there is predetermined clearance between the wheel's friction surface material on the sides of the wheel and said friction surfaces in the wheel-well and between the wheel's concave depression frame's friction element and said friction disk's perimeter friction material.

38. The wheeled device as defined in claim 36, wherein the frame includes a wheel-well, the wheel-well having opposing friction surfaces arranged such that; when the wheel is rotating at an inclination, there are three simultaneous friction contacts: one with said wheel-well friction surface and the wheel's friction member and two simultaneously with said friction disk and wheel's friction element on each side of said wheel, realigmnent of said wheel to vertical rotation is achieved by the force of the integral compression spring.

39. The wheeled device as defined in claim 38, wherein said wheel includes external self-aligning springs that are attached to said concave depression frames, said springs being located at each end of said axle such that: when the wheel is rotating at an inclination, there are two simultaneous self-aligning spring locations; one at the wheel hub's integral compression spring and one by the pair of said self-aligning springs located at each end of said axle.

40. The wheeled device as defined in claim 39, wherein said external self-aligning springs are one of an accordion pleated sheet metal alloy spring and an accordion pleated reinforced rubberized spring, wherein the pleated springs are configured to serve a dual function as dust covers.

41. The wheeled device as defined in claim 39, wherein the wheel frame is mounted to one of an in-line skate, an in-line skateboard, a downhill in-line ski and a downhill in-line skateboard.

42. The wheeled device as defined in claim 38, wherein said wheel is in a generally parabolic shape.

43. The wheeled device as defined in claim 38, wherein the wheel frame is mounted to one of an in-line skate, an in-line skateboard, a downhill in-line ski and a downhill in-line skateboard.

44. The wheeled device as defined in claim 22, wherein the wheel frame is attached to one of an in-line skate, an in-line skateboard, a downhill in-line ski and a downhill in-line skateboard.

* * * * *

UNITED STATES PATENT AND TRADEMARK OFFICE

CERTIFICATE OF CORRECTION

PATENT NO. : 6,848,750 B2
DATED : February 1, 2005
INVENTOR(S) : Myron Stuart Hurwitz It is certified that error appears in the above-identified patent and that said Letters Patent is hereby corrected as shown below:

Title page,
Item [57], ABSTRACT, delete ABSTRACT and insert
-- The outlined frame of in-line skate (FIG. 16 B) supports a self-contained wheel assemblythat allows a skater to effectively slow down and stop, using a ski-like technique. The wheel (31) has a novel 2-element spherical bearing hub (32 A & 32 B), which provides the means for wheel (31) to rotate around axle (40) vertically and at an angle. The inside hub element (32 A) has axle roller bearings (25 B). The concave wheel frame (28 B) has an indented friction surface (43) on each side of the wheel. When at an angle the wheel's friction surface contacts a friction surface (41 A) on disk (41). This friction contact each side of the wheel occurs simultaneously to slow or brake the wheel in a manner comparable to edging skis. The 2-element hub has a concentric self-aligning spring (34 A) that keeps the wheel in a vertical (coasting) position. When angling ("edging") the wheels for control and braking and then releasing the edging pressure, the self-aligning spring forces the wheel back into the vertical coasting position. The self-aligning spring can be made from soft to hard to satisfy the abilities of a beginner to an expert. --

Drawings,
FIG. 16 B, Two No. 43 detail numerals were added for further clarification. Thoug indicated in FIG. 16 A and noted in the "Detailed Description", those reference numerals in FIG. 16 B (though noted in the "Detailed Description" were unintentionally absent in the drawing. In addition, reference numeral 41s arrow-head for the "fixed solid disk" (on the right side) did not terminate corectly. (drawing attached)
FIG. 17, Reference numeral 28 B was unintentionally absent from the drawing and has been correctly added to the drawing. (drawing attached)
FIG. 20, Though defined in the list of "Definition of all Reference Numerals Indicated in Drawings", reference numeral 50 in FIG. 20 G was unintentionally absent and has been added. In addition, the top line of graphic scale 51 was added for better delineation. (drawing attached)

Column 2,
Line 16, delete "state" and insert -- state --

Column 3,
Line 40, after " 3/4 " insert (symbol for inches) -- " --

Column 4,
Line 66, after "springs" delete from parenthesis symbol “-”

UNITED STATES PATENT AND TRADEMARK OFFICE

CERTIFICATE OF CORRECTION

PATENT NO. : 6,848,750 B2
DATED : February 1, 2005
INVENTOR(S) : Myron Stuart Hurwitz It is certified that error appears in the above-identified patent and that said Letters Patent is hereby corrected as shown below:

Column 5,
Line 9, delete "rationle" and insert -- rationale --
Line 63, delete "also," and insert -- Also, --
Line 65, after "hub," delete ";"

Column 6,
Line 20, after " 3/32 " insert (symbol for inches) -- " --

Column 9,
Line 16, after "players" insert -- ). --
Line 39, delete "Colo" and insert -- CO --

Column 10,
Line 21, delete "skis" (second occurrence) and insert -- ski --
Line 34, delete "post" and insert -- Post --

Column 15,
Line 7, delete "mag-" and insert -- maxi- --

Column 16,
Line 24, delete "does not" first occurrence.
Line 46, delete "13".
Line 50, delete "endosed" and insert -- enclosed --

Column 17,
Lines 1-7, delete and insert
-- FIG. 3 A is a composite illustration of an individual on in-line skates 19A in a coasting (vertical wheel rotation) position and a reduced cross section view of FIG. 2 A, depicting wheel 10 in a comparable vertical, coasting position. All the other identifiable component parts as shown in the reduced cross section view, remain the same as presented and described in the preceding full size cross section view of FIG. 2 B. --
Lines 8-18, delete and insert
-- FIG. 3 B is a composite illustration of an individual on in-line skates 19B in a striding (side to side) position and a reduced modified cross section view of FIG. 2 A, depicting wheel 10 in a comparably inclined striding and edging friction contact position 11C. In that inclined EDGING FRICTION CONTROL™ position of 11C, the self-aligning springs 14 are in an equal and opposite compression 14A and tension 14B state which (as soon as the edging control force is released), will return to a state of equilibrium, wherein the wheel is back into a vertical, coasting position. --
Line 29, delete "service" and insert -- surface --
Line 32, delete "slate" and insert -- skate --

UNITED STATES PATENT AND TRADEMARK OFFICE

CERTIFICATE OF CORRECTION

PATENT NO. : 6,848,750 B2
DATED : February 1, 2005
INVENTOR(S) : Myron Stuart Hurwitz It is certified that error appears in the above-identified patent and that said Letters Patent is hereby corrected as shown below:

Column 18,
Line 36, after "FIG. 10A" insert -- is a --
Line 47, after "needle roller axle" insert -- bearing 25A --
Line 57, delete "and" second occurrence.

Column 19,
Line 46, delete "20C" and insert -- 14C --
Line 53, after "26 A/B" insert -- (as shown in FIGs. 10 B&C) -- and after "36A" insert -- (as shown in FIGs. 14 D&E) --
Line 56, after "33" delete "," and insert -- (33/34), --
Line 57, after "33A" insert -- (as noted in FIG. 14B), --

Column 20,
Line 3, delete "31" and insert -- (not indicated) --
Line 25, after "36A" insert -- (as shown in FIGs. 14 D&E) --
Line 26, after "self-lubricated" insert -- center --
Line 52, after "fineal nut" insert -- 42 --
Line 54, after "locknut" insert -- 42 --

Column 21,
Lines 15-28, delete.
Line 34, after "screw" insert -- 40 --
Line 38, after "hub" insert -- 32 --
Line 51, delete "23B" and insert -- 28B --
Line 53, after "assembly" delete -- 61 --
Line 62, delete "31B" and insert -- 10 --

Column 22,
Line 35, delete "11C" (second occurrence).
Line 62, delete "on" and insert -- one --

UNITED STATES PATENT AND TRADEMARK OFFICE

CERTIFICATE OF CORRECTION

PATENT NO. : 6,848,750 B2
DATED : February 1, 2005
INVENTOR(S) : Myron Stuart Hurwitz It is certified that error appears in the above-identified patent and that said Letters Patent is hereby corrected as shown below:

Column 23,
Line 32, delete "apposing" and insert -- opposing --

Signed and Sealed this

Ninth Day of August, 2005

JON W. DUDAS
*Director of the United States Patent and Trademark Office*